US006774099B1

(12) United States Patent
Scheibel et al.

(10) Patent No.: US 6,774,099 B1
(45) Date of Patent: Aug. 10, 2004

(54) DISHWASHING DETERGENT COMPOSITIONS CONTAINING MIXTURES OR CRYSTALLINITY-DISRUPTED SURFACTANTS

(75) Inventors: Jeffrey John Scheibel, Loveland, OH (US); Thomas Anthony Cripe, Loveland, OH (US); Kevin Lee Kott, Cincinnati, OH (US); Daniel Stedman Connor, Cincinnati, OH (US); James Charles Theophile Roger Burckett-St. Laurent, Cincinnati, OH (US); Phillip Kyle Vinson, Fairfield, OH (US); William Michael Scheper, Lawrenceburg, IN (US); Chandrika Kasturi, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/889,632

(22) PCT Filed: Dec. 15, 1999

(86) PCT No.: PCT/US99/29776

§ 371 (c)(1),
(2), (4) Date: Jul. 19, 2001

(87) PCT Pub. No.: WO00/43476

PCT Pub. Date: Jul. 27, 2000

Related U.S. Application Data

(60) Provisional application No. 60/116,515, filed on Jan. 20, 1999.

(51) Int. Cl.[7] ..... C11D 17/00

(52) U.S. Cl. ..... 510/357; 510/424; 510/426; 510/428; 510/499

(58) Field of Search ..... 510/357, 424, 510/426, 428, 535

(56) References Cited

U.S. PATENT DOCUMENTS

| | | | | |
|---|---|---|---|---|
| 2,477,382 | A | | 7/1949 | Lewis |
| 2,564,072 | A | | 8/1951 | Lien et al. |
| 3,196,174 | A | | 7/1965 | Cohen |
| 3,238,249 | A | | 3/1966 | Mirviss et al. |
| 3,312,745 | A | | 4/1967 | Habershaw et al. |
| 3,341,614 | A | | 9/1967 | Wirth et al. |
| 3,355,484 | A | | 11/1967 | Bloch |
| 3,442,964 | A | | 5/1969 | Oldham |
| 3,442,965 | A | | 5/1969 | Oldham |
| 3,492,364 | A | | 1/1970 | Jones et al. |
| 3,674,885 | A | | 7/1972 | Griesinger et al. |
| 4,301,316 | A | | 11/1981 | Young |
| 4,301,317 | A | | 11/1981 | Young |
| 4,447,664 | A | | 5/1984 | Murchison et al. |
| 4,533,651 | A | | 8/1985 | Masters et al. |
| 4,587,374 | A | | 5/1986 | Peters |
| 4,855,527 | A | | 8/1989 | Page et al. |
| 4,870,038 | A | | 9/1989 | Page et al. |
| 4,959,491 | A | | 9/1990 | Threlkel |
| 4,962,256 | A | | 10/1990 | Le et al. |
| 4,973,788 | A | | 11/1990 | Lin et al. |
| 4,990,718 | A | | 2/1991 | Pelrine |
| 4,996,386 | A | | 2/1991 | Hamilton, Jr. et al. |
| 5,026,933 | A | | 6/1991 | Blain et al. |
| 5,087,788 | A | | 2/1992 | Wu |
| 5,196,624 | A | | 3/1993 | Threlkel |
| 5,196,625 | A | | 3/1993 | Threlkel |
| 5,210,060 | A | | 5/1993 | Radlowski |
| 5,510,306 | A | | 4/1996 | Murray |
| 5,625,105 | A | | 4/1997 | Lin et al. |
| 6,274,540 | B1 | * | 8/2001 | Scheibel ..... 510/352 |
| 6,306,817 | B1 | * | 10/2001 | Kott et al. ..... 510/535 |
| 6,365,561 | B1 | * | 4/2002 | Vinson et al. ..... 510/235 |

FOREIGN PATENT DOCUMENTS

| | | | |
|---|---|---|---|
| EP | 466558 | A | 7/1990 |
| EP | 469940 | A1 | 2/1992 |
| EP | 364012 | B1 | 1/1993 |
| FR | 2697246 | A1 | 10/1992 |
| SU | 793972 | | 4/1979 |
| WO | WO 88/07030 | A2 | 9/1988 |
| WO | WO 95/17961 | A2 | 7/1995 |
| WO | WO 95/18084 | A1 | 7/1995 |
| WO | WO 99/05082 | | 2/1999 |
| WO | WO 99/05084 | | 2/1999 |
| WO | WO 99/05241 | | 2/1999 |
| WO | WO 99/05242 | | 2/1999 |
| WO | WO 99/05243 | | 2/1999 |
| WO | 99/05243 | * | 2/1999 |
| WO | WO 99/05244 | | 2/1999 |

OTHER PUBLICATIONS

"Alkylarysulfonates: History, Manufacture, Analysis and Environmental Properties", Surfactant Science, vol. 56, Chapter 2 pp. 39–108, 1996, Marcel Dekker, NY.

* cited by examiner

*Primary Examiner*—Necholus Ogden
(74) *Attorney, Agent, or Firm*—Laura R. Grunzinger; Kim W. Zerby; Steven W. Miller

(57) ABSTRACT

A hand dishwashing compositions comprising; a) about 0.1% to about 99.9% by weight of said composition of an alkylarylsulfonate surfactant system comprising from about 10% to about 100% by weight of said surfactant system of two or more crystallinity-disrupted alkylarylsulfonate surfactants of formula $(B—Ar—D)_a(M^{q+})_b$ wherein D is $SO_3$—, M is a cation or cation mixture, q is the valence of said cation, a and b are numbers selected such that said composition is electroneutral; Ar is selected from benzene, toluene, and combinations thereof; and B comprises the sum of at least one primary hydrocarbyl moiety containing from 5 to 20 carbon atoms and one or more crystallinity-disrupting moieties, wherein said crystallinity-disrupting moieties interrupt or branch from said hydrocarbyl moiety; and wherein said alkylarylsulfonate surfactant system has crystallinity disruption to the extent that its Sodium Critical Solubility Temperature, as measured by the CST Test, is no more than about 40° C.; and wherein further said alkylarylsulfonate surfactant system has at least one of the following properties: percentage biodegradation, as measured by the modified SCAS test, that exceeds tetrapropylene benzene sulfonate; and weight ratio of nonquaternary to quaternary carbon atoms in B of at least about 5:1; and b) from about 0.00001% to about 99.9% by weight of said composition of a conventional hand dishwashing adjunct; c) from about 0.01% to about 7% by weight of composition of a divalent ion selected from the group consisting of magnesium, calcium and mixtures thereof.

16 Claims, No Drawings

DISHWASHING DETERGENT COMPOSITIONS CONTAINING MIXTURES OR CRYSTALLINITY-DISRUPTED SURFACTANTS

CROSS REFERENCE TO RELATED APPLICATIONS

This application is a 371 of PCT US/99/29766 filed Dec. 15, 1999 which claims benefit of Ser. No. 60/116,515 filed Jan. 20, 1999.

FIELD OF THE INVENTION

The present invention relates to dishwashing compositions comprising a alkylarylsulfonate surfactant system containing a mixture of isomers of crystallinity-disrupted, preferably branched, alkylarylsulfonate surfactants and optionally one or more noncrystallinity-disrupted alkylarylsulfonate surfactants.

BACKGROUND OF THE INVENTION

Typical commercial hand dishwashing compositions incorporate divalent ions (Mg, Ca) to ensure adequate grease performance in soft water. However, the presence of divalent ions in formulas containing anionic, nonionic, or additional surfactants (e.g., amine oxide, alkyl ethoxylate, LAS, alkanoyl glucose amide, alkyl betaines) leads to slower rates of product mixing with water (and hence poor flash foam), poor rinsing, and poor low temperature stability properties. Moreover, preparation of stable dishwashing detergents containing Ca/Mg is very difficult due to the precipitation issues associated with Ca and Mg as pH increases. Consequently, there remains the need for a detergent composition suitable for hand dishwashing, which is stable at low temperatures, and additionally can provide grease removal and tough food cleaning benefits, in hard water and at pH's, typically pH 9 or lower, where a conventional Ca/Mg system would be unstable and not provide grease removal and tough food cleaning benefits.

BACKGROUND ART

U.S. Pat. No. 5,026,933; U.S. Pat. No. 4,990,718; U.S. Pat. No. 4,301,316; U.S. Pat. No. 4,301,317; U.S. Pat. No. 4,855,527; U.S. Pat. No. 4,870,038; U.S. Pat. No. 2,477,382; EP 466,558, Jan. 15, 1992; EP 469,940, Feb. 5, 1992; FR 2,697,246, Apr. 29, 1994; SU 793,972, Jan. 7, 1981; U.S. Pat. No. 2,564,072; U.S. Pat. No. 3,196,174; U.S. Pat. No. 3,238,249; U.S. Pat. No. 3,355,484; U.S. Pat. No. 3,442,964; U.S. Pat. No. 3,492,364; U.S. Pat. No. 4,959,491; WO 88/07030, Sep. 25, 1990; U.S. Pat. No. 4,962,256, U.S. Pat. No. 5,196,624; U.S. Pat. No. 5,196,625; EP 364,012 B, Feb. 15, 1990; U.S. Pat. No. 3,312,745; U.S. Pat. No. 3,341,614; U.S. Pat. No. 3,442,965; U.S. Pat. No. 3,674,885; U.S. Pat. No. 4,447,664; U.S. Pat. No. 4,533,651; U.S. Pat. No. 4,587,374; U.S. Pat. No. 4,996,386; U.S. Pat. No. 5,210,060; U.S. Pat. No. 5,510,306; WO 95/17961, Jul. 6, 1995; WO 95/18084; U.S. Pat. No. 5,510,306; U.S. Pat. Nos. 5,087,788; 4,301,316; 4,301,317; 4,855,527; 4,870,038; 5,026,933; 5,625,105 and 4,973,788. The manufacture of alkylbenzenesulfonate surfactants has recently been reviewed. See Vol. 56 in "Surfactant Science" series, Marcel Dekker, New York, 1996, including in particular Chapter 2 entitled "Alkylarylsulfonates: History, Manufacture, Analysis and Environmental Properties", pages 39–108 which includes 297 literature references. Documents referenced herein are incorporated in their entirety.

SUMMARY OF THE INVENTION

It has now been surprisingly found that when an alkylarylsulfonate surfactant system includes two or more isomers of crystallinity-disrupted alkylarylsulfonate surfactants, optionally containing also one or more noncrystallinity-disrupted alkylarylsulfonate surfactants, there is a surprising increase in performance over alkylarylsulfonate surfactant system which do not include the crystallinity-disrupted alkylarylsulfonate surfactant isomers.

The present invention has numerous advantages beyond one or more of the aspects identified hereinabove, including but not limited to: superior cold-water solubility, for example for cold water cleaning; superior hardness tolerance; and excellent detergency. Further, the invention is expected to provide improved removal of lipid or greasy soils. The development offers substantial expected improvements in ease of manufacture of relatively high 2-phenyl sulfonate compositions, improvements also in the ease of making and quality of the resulting formulations; and attractive economic advantages.

The present invention is based on an unexpected discovery that there exist, in the middle ground between the old, highly branched, nonbiodegradable alkylbenzenesulfonates and the new linear types, certain alkylbenzenesulfonates which are both more highly performing than the latter and more biodegradable than the former.

The new alkylbenzenesulfonates are readily accessible by several of the many of known alkylbenzenesulfonate manufacturing processes. For example, the use of certain dealuminized mordenites permits their convenient manufacture.

In accordance with the present invention, a novel hand dishwashing composition is provided. This novel hand dishwashing composition comprises a) about 0.1% to about 99.90% by weight of said composition of an alkylarylsulfonate surfactant system comprising from about 10% to about 100% by weight of said surfactant system of two or more crystallinity-disrupted alkylarylsulfonate surfactants of formula $$(B—Ar—D)a(Mq+)b$$

wherein D is SO3-, M is a cation or cation mixture, q is the valence of said cation, a and b are numbers selected such that said composition is electroneutral; Ar is selected from benzene, toluene, and combinations thereof; and B comprises the sum of at least one primary hydrocarbyl moiety containing from 5 to 20 carbon atoms, preferably 7 to 16, more preferably 9–15, most preferably 10–14 carbon atoms and one or more crystallinity-disrupting moieties wherein said crystallinity-disrupting moieties interrupt or branch from said hydrocarbyl moiety; and wherein said alkylarylsulfonate surfactant system has crystallinity disruption to the extent that its Sodium Critical Solubility Temperature, as measured by the CST Test, is no more than about 40° C. and wherein further said alkylarylsulfonate surfactant system has at least one of the following properties:

percentage biodegradation, as measured by the modified SCAS test, that exceeds tetrapropylene benzene sulfonate; and weight ratio of nonquaternary to quaternary carbon atoms in B of at least about 5:1 (preferably at least about 10:1; more preferably at least about 100:1); and b) from about 0.00001% to about 99.90% by weight of said composition of a conventional hand dishwashing adjunct;

c) from about 0.01% to about 7% by weight of composition of a divalent ion selected from the group consisting of magnesian, calcium and mixtures thereof.

The composition will preferably contain at least about 0.1%, more preferably at least about 0.5%, even more preferably, still at least about 1% by weight of said composition of the surfactant system. The cleaning composition will also preferably contain no more than about 80%, more preferably no more than about 60%, even more preferably, still no more than about 40% by weight of said composition of the surfactant system.

The surfactant system will preferably contain at least about 15%, more preferably at least about 30%, even more preferably, still at least about 40% by weight of said surfactant system of two or more crystallinity disrupted alkyarylsulfonate surfactants. The surfactant system will also preferably contain no more than about 100%, more preferably no more than about 90%, even more preferably, still no more than about 80% by weight of said surfactant system of two or more crystallinity disrupted alkyarylsulfonate surfactants.

Accordingly, it is an aspect of the present invention to provide novel cleaning compositions. These, and other, aspects, features and advantages will be clear from the following detailed description and the appended claims.

All percentages, ratios and proportions herein are by weight of ingredients used to prepare the finished compositions unless otherwise specified. All temperatures are in degrees Celsius (° C.) unless otherwise specified. All documents cited herein are, in relevant part, incorporated herein by reference.

DETAILED DESCRIPTION OF THE INVENTION

The present invention relates to novel hand dishwashing compositions. Component (a) contains from about 0.1% to about 99.91% by weight of said composition of an alkylarylsulfonate surfactant system comprising from about 10% to about 100% by weight of said surfactant system of two or more crystallinity-disrupted alkylarylsulfonate surfactants of formula $$(B—Ar—D)a(Mq+)b$$

wherein D is SO3-. M is a cation or cation mixture. Preferably, M is an alkali metal, an alkaline earth metal, ammonium, substituted ammonium or mixtures thereof, more preferably sodium, potassium, magnesium, calcium or mixtures thereof. The valence of said cation, q, is preferably 1 or 2. The numbers selected such that said composition is electroneutral, a and b, are preferably 1 or 2 and 1 respectively.

Ar preferably is selected from benzene, toluene, and combinations thereof, and most preferably benzene.

B comprises the sum of at least one primary hydrocarbyl moiety containing from 5 to 20 carbon atoms and one or more crystallinity-disrupting moieties wherein said crystallinity-disrupting moieties interrupt or branch from said hydrocarbyl moiety. Preferably, B includes both odd and even chain length of the hydrocarbyl moiety. That is, it is preferred that B is not limited to being all odd or all even chain length of the hydrocarbyl moiety. The primary hydrocarbyl moiety of B has from 5 to 20, preferably 7 to 16 carbon atoms. There may be from one to three crystallinity-disrupting moieties. The crystallinity-disrupting moieties interrupt or branch from said hydrocarbyl moiety. When the crystallinity-disrupting moieties are branches they are, preferably C1–C3 alkyl, C1–C3 alkoxy, hydroxy and mixtures thereof, more preferably C1–C3 alkyl, most preferably C1–C2 alkyl, more preferably still methyl. When the crystallinity-disrupting moieties interrupt the hydrocarbyl moiety they are, preferably ether, sulfone, silicone and mixtures thereof, more preferably ether. It is preferred that the crystallinity-disrupted alkylarylsulfonate surfactants include two or more homologs. "Homologs" vary in the number of carbon atoms contained in B. "Isomers", which are described herein after in more detail, include especially those compounds having different positions of attachment of the crystallinity-disrupting moieties to B.

It is also preferred that the crystallinity-disrupted alkylarylsulfonate surfactants include at least two "isomers" selected from i) ortho-, meta- and para-isomers based on positions of attachment of substituents to Ar, when Ar is a substituted or unsubstituted benzene. This meant that B can be ortho-, meta- and para- to D, B can be ortho-, meta- and para- to a substituent on Ar other than D, D can be ortho-, meta- and para- to a substituent on Ar other than B, or any other possible alternative;

ii) positional isomers based on positions of attachment of said crystallinity-disrupting moieties to said primary hydrocarbyl moiety of B; and iii) stereoisomers based on chiral carbon atoms in B.

It is more preferred that the crystallinity-disrupted alkylarylsulfonate surfactants will include at least two isomers of type ii), most preferably at least four isomers of type ii).

Preferably, at least about 60% by weight of said surfactant system of said crystallinity-disrupted alkylarylsulfonate surfactants is in the form of isomers wherein Ar is attached to B at the first, second or third carbon atom in said primary hydrocarbyl moiety thereof, more preferably about 70% or more, most preferably about 80% or more.

An optional component of the present invention compositions is from about 0% to about 85%, by weight of the surfactant system, of one or more noncrystallinity-disrupted alkylarylsulfonate surfactants of formula $$(L—Ar—D)a(Mq+)b$$

wherein D, M, q, a, b, Ar, are as defined above. L is a linear primary hydrocarbyl moiety containing from 5 to 20 carbon atoms. Preferably, L is a linear hydrocarbyl moiety having from 7 to 16 carbon atoms.

The alkylarylsulfonate surfactant system has crystallinity disruption to the extent that its Sodium Critical Solubility Temperature, as measured by the CST Test, which is defined hereinafter, is no more than about 40° C., preferably no more than about 20° C., most preferably no more than about 5° C. It is also preferable that its Calcium Critical Solubility Temperature, as measured by the CST Test, is below about 80° C., preferably no more than about 40° C., more preferably no more than about 20° C.

The alkylarylsulfonate surfactant system also has at least one of the following properties:

a) percentage biodegradation, as measured by the modified SCAS test (described herein after), that exceeds tetra propylene benzene sulphonate; or b) a weight ratio of nonquaternary to quaternary carbon atoms in B of at least about 5:1. Preferably, the weight ratio of nonquaternary to quaternary carbon atoms in B is at least about 10:1, more preferably at least about 20:1, and most preferably at least about 100:1.

More preferably, percentage biodegradation in absolute terms, is preferably at least about 60%, more preferably at least 70%, still more preferably at least 80% and most preferably at least 90%, as measured by the modified SCAS test.

The hand dishwashing compositions of the present invention also comprise (b) from about 0.00001% to about 99.9% by weight of said composition of a conventional hand dishwashing adjunct; and (c) from about 0.01% to about 7% by weight of composition of a divalent ion selected from the group consisting of magnesium, calcium and mixtures thereof. These materials, as well as other materials optionally useful herein, are described in detail hereafter.

Related to the composition are methods of their use, such as a method contacting soiled tableware in need of cleaning with either a neat or an aqueous solution of the composition of the invention. Such methods may optionally include the step of diluting the composition with water. Furthermore, the composition may be applied, either neat or as an aqueous solution, directly to the tableware or surface to be cleaned or directly to a cleaning implement, such as a sponge or a wash cloth. Such methods are part of the present invention.

Crystallinity Disruption

The term "crystallinity-disrupted" as defined herein means that a surfactant that is being referred to is one containing a hydrophobic moiety selected to result in a surfactant which packs less efficiently into a crystal lattice than does a reference surfactant in which the hydrophobe is a pure linear hydrocarbon chain of formula CH3(CH2)n- having length or range of chain lengths comparable to that of the surfactant being described.

Crystallinity disruption can, in general, flow from any of several modifications of the surfactant at the molecular level. Notably, a linear hydrophobe such as

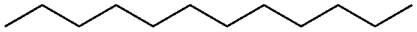

i.e., CH3(CH2)11-, which itself is "noncrystallinity disrupted" can be modified to form a crystallinity-disrupted structure in accordance with the invention by inserting various moieties such as ether moieties, silicone or sulfones into the chain as in:

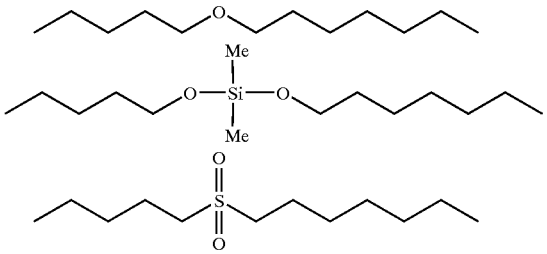

More preferably, crystallinity disruption herein takes place when one or more branchings from B are added to the structure, as in:

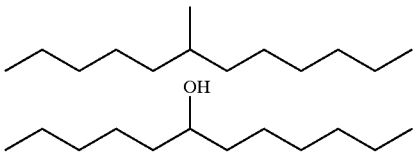

or

Note with respect to the surfactants herein having the formulae (B—Ar—D)a(Mq+)b and (L—Ar—D)a(Mq+)b that B represents a crystallinity-disrupted hydrophobe whereas L represents a non-crystallinity disrupted hydrophobe. Also, in alternate terms, the crystallinity-disrupted hydrophobe B comprises a primary moiety which consists of (i) all components in B other than the crystallinity-disrupting moieties; and (ii) the crystallinity-disrupting moieties.

In a preferred embodiment, B has (i) a moiety having from 7 to 16 carbon atoms and (ii) a crystallinity-disrupting moiety selected from (a) branches (or "side-chains") attached to B which may in general vary but which preferably are selected from C1–C3 alkyl, hydroxy and mixtures thereof, more preferably C1–C3 alkyl, most preferably C1–C2 alkyl, more preferably still methyl; (b) moieties which interrupt the structure of B, selected from ether, sulfone, silicone; and (c) mixtures thereof. Other crystallinity-disrupting moieties, not preferred herein, include olefin.

Alkylarylsulfonate Surfactant System

An essential component of the hand dishwashing composition of the present invention is an alkylarylsulfonate surfactant system. The alkylarylsulfonate surfactant system comprises an essential crystallinity disrupting component.

The present invention relates to cleaning compositions comprising at least two or more such crystallinity-disrupted alkylarylsulfonate surfactants, and optionally, one or more noncrystallinity-disrupted alkylarylsulfonate surfactants. These two components are described as follows:

(1) Crystallinity-disrupted Alkylarylsulfonate Surfactants:

The present invention hand dishwashing compositions comprise an alkylarylsulfonate surfactant system which contains at least two or more crystallinity-disrupted alkylarylsulfonate surfactants having the formula $$(B—Ar—D)a(Mq+)b$$

wherein D, B, M, q, a, b, Ar, are as hereinbefore defined. Possible crystallinity-disrupted alkylarylsulfonate surfactants include:

(a)

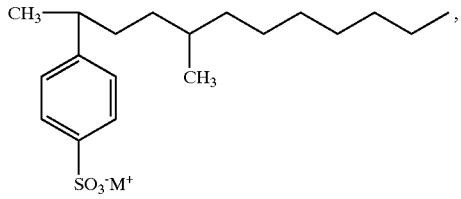

(b)

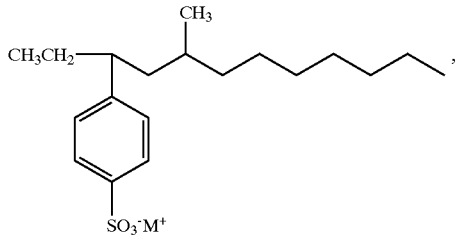

(c)

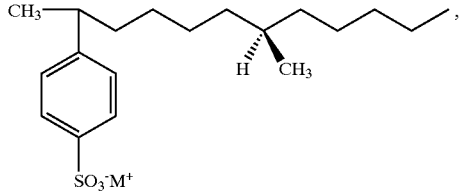

-continued
(d)
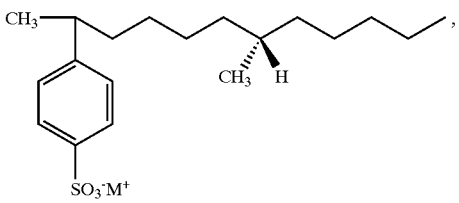
(e)
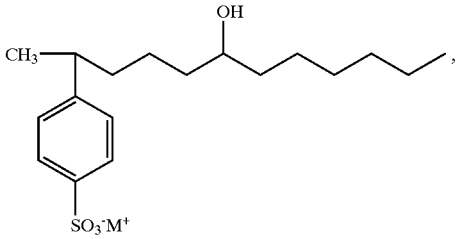
(f)
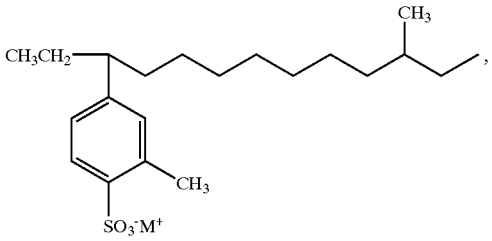
(g)
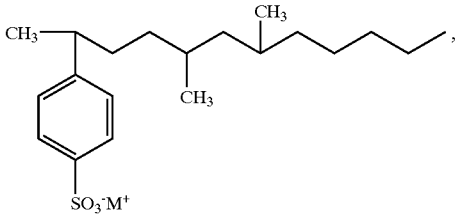
(h)
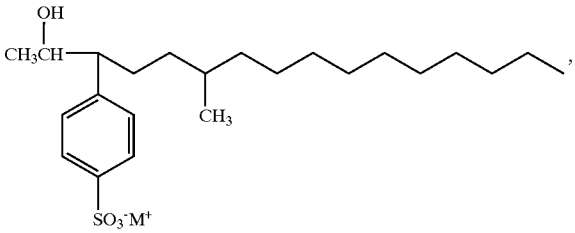
(i)
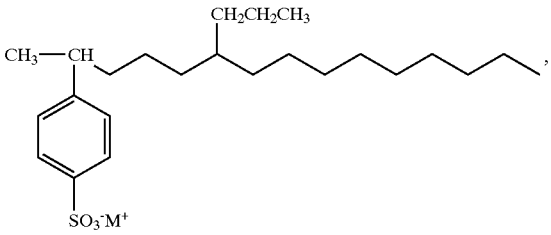
-continued
(j)
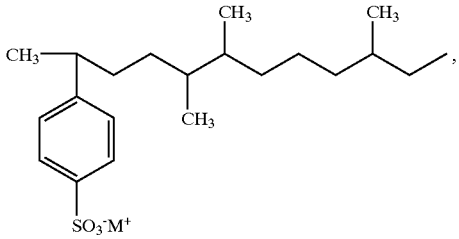
(k)
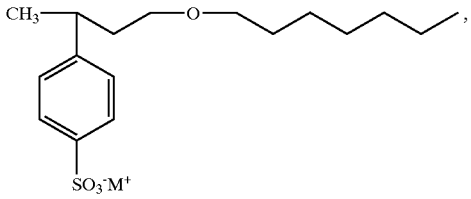
(l)
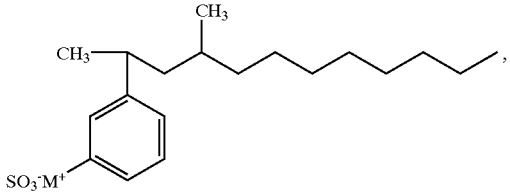
(m)
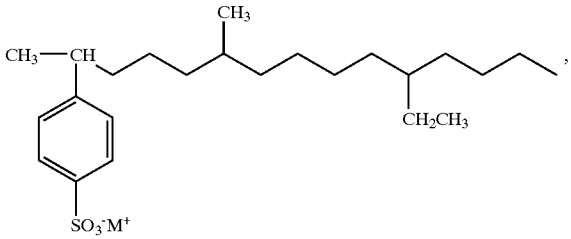
(n)
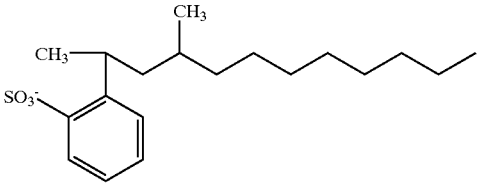
and
(o)
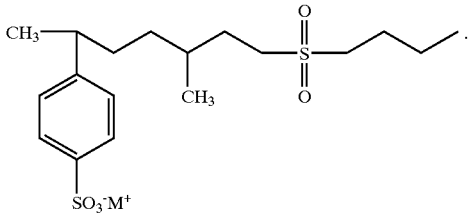
Structures (a) to (o) are only illustrative of some possible crystallinity-disrupted alkylarylsulfonate surfactants and are not intended to be limiting in the scope of the invention.

It is also preferred that the crystallinity-disrupted alkylarylsulfonate surfactants include at least two isomers selected from i) ortho-, meta- and para-isomers based on positions of attachment of substituents to Ar, when Ar is a substituted or unsubstituted benzene. This means that B can be ortho-, meta- and para- to D, B can be ortho-, meta- and para- to a substituent on Ar other than D, D can be ortho-, meta- and para- to a substituent on Ar other than B, or any other possible alternative;

ii) positional isomers based on positions of attachment of said crystallinity-disrupting moieties to said primary hydrocarbyl moiety of B; and iii) stereoisomers based on chiral carbon atoms in B.

An example of two type (ii) isomers are structures are (a) and (c). The difference is that the methyl in (a) is attached at the 5 position, but in (c) the methyl is attached to the 7 position.

An example of two type (i) isomers are structures are (l) and (n). The difference is that the sulfonate group in (l) is meta- to the hydrocarbyl moiety, but in (n) the sulfonate is ortho- to the hydrocarbyl moiety.

An example of two type (iii) isomers are structures are (c) and (d). The difference is that these isomers are stereoisomers. The chiral carbon being the 7th carbon atom in the hydrocarbyl moiety.

(2) Noncrystallinity-disrupted Alkylarylsulfonate Surfactants:

The present inventive hand dishwashing compositions may further optionally comprise an alkylarylsulfonate surfactant system which can contain one or more noncrystallinity-disrupted alkylarylsulfonate surfactants having the formula $$(L—Ar—D)_a(Mq+)_b$$

wherein D, M, L, q, a, b, Ar, are as hereinbefore defined. Possible noncrystallinity-disrupted alkylarylsulfonate surfactants include standard linear alkylbenzene sulfonates, such as those which are commercially available, e.g., the so-called high 2-phenyl linear alkyl benzene sulfonates, better known as DETAL or conventional LAS available from Huntsman or Vista. These linear alkylaryl sulfonates can be added to the crystallinity-disrupted alkylarylsulfonate surfactants to provide the alkylarylsulfonate surfactant system used in the cleaning composition of the present invention. Alternatively, the noncrystallinity-disrupted alkylarylsulfonate surfactants and the crystallinity-disrupted alkylarylsulfonate surfactants are produced in the same reaction, possibly due to isomerization either before, during or after the reaction. The ratio of noncrystallinity-disrupted alkylarylsulfonate to crystallinity-disrupted alkylarylsulfonate depends on the catalyst used. Whichever catalyst is used, the surfactant system must have a Sodium Critical Solubility Temperature of no more than about 40° C. and either percentage biodegradation, as measured by the modified SCAS Test, that exceeds tetrapropylenebenzene sulfonate, preferably greater than 60%, more preferably greater than 80% or a weight ratio of nonquaternary to quaternary carbon atoms in B of at least about 5:1.

EXAMPLE 1

Crystallinity Disrupted Surfactant System Prepared Via Skeletally Isomerized Linear Olefin Step (a), At Least Partially Reducing the Linearity of an Olefin (by Skeletal Isomerization of Olefin Preformed to Chainlengths Suitable for Cleaning Product Detergency)

A mixture of 1-decene, 1-undecene, 1-dodecene and 1-tridecene (for example available from Chevron) at a weight ratio of 1:2:2:1 is passed over a Pt-SAPO catalyst at 220° C. and any suitable LHSV, for example 1.0. The catalyst is prepared in the manner of Example 1 of U.S. Pat. No. 5,082,956. See WO 95/21225, e.g., Example 1 and the specification thereof. The product is a skeletally isomerized lightly branched olefin having a range of chainlengths suitable for making alkylbenezenesulfonate surfactant for consumer cleaning composition incorporation. More generally the temperature in this step can be from about 200° C. to about 400° C., preferably from about 230° C. to about 320° C. The pressure is typically from about 15 psig to about 2000 psig, preferably from about 15 psig to about 1000 psig, more preferably from about 15 psig to about 600 psig. Hydrogen is a useful pressurizing gas. The space velocity (LHSV or WHSV) is suitably from about 0.05 to about 20. Low pressure and low hourly space velocity provide improved selectivity, more isomerization and less cracking. Distill to remove any volatiles boiling at up to 40° C./10 mmHg.

Step (b): Alkylating the Product of Step (a) Using an Aromatic Hydrocarbon

To a glass autoclave liner is added 1 mole equivalent of the lightly branched olefin mixture produced in step (a), 20 mole equivalents of benzene and 20 wt. % based on the olefin mixture of a shape selective zeolite catalyst (acidic mordenite catalyst Zeocat™ FM-8/25H). The glass liner is sealed inside a stainless steel rocking autoclave. The autoclave is purged twice with 250 psig N2, and then charged to 1000 psig N2. With mixing, the mixture is heated to 170–190° C. for 14–15 hours at which time it is then cooled and removed from the autoclave. The reaction mixture is filtered to remove catalyst and is concentrated by distilling off unreacted starting-materials and/or impurities (e.g., benzene, olefin, paraffin, trace materials, with useful materials being recycled if desired) to obtain a clear near-colorless liquid product. The product can then be formed into a desirable crystallinity-disrupted surfactant system which can, as an option, be shipped to a remote manufacturing facility where the additional steps of sulfonation and incorporation into consumer cleaning compositions can be accomplished.

Step (c): Sulfonating the Product of Step (b)

The product of step (b) is sulfonated with an equivalent of chlorosulfonic acid using methylene chloride as solvent. The methylene chloride is distilled away.

Step (d): Neutralizing the Product of Step (c)

The product of step (c) is neutralized with sodium methoxide in methanol and the methanol evaporated to give a crystallinity-disrupted surfactant system.

EXAMPLE 2

Crystallinity Disrupted Surfactant System Prepared Via Skeletally Isomerized Linear Olefin The procedure of Example 1 is repeated with the exception that the sulfonating step, (c), uses sulfur trioxide (without methylene chloride solvent) as sulfonating agent. Details of sulfonation using a suitable air/sulfur trioxide mixture are provided in U.S. Pat. No. 3,427,342, Chemithon. Moreover, step (d) uses sodium hydroxide in place of sodium methoxide for neutralization.

EXAMPLE 3

Crystallinity Disrupted Surfactant System Prepared Via Skeletally Isomerized Linear Olefin Step (a); At Least Partially Reducing the Linearity of an Olefin A lightly branched olefin mixture is prepared by passing a mixture of C11, C12 and C13 mono olefins in the weight ratio of 1:3:1 over H-ferrierite catalyst at 430° C. The method and catalyst of U.S. Pat. No. 5,510,306 can be used for this step. Distil to remove any volatiles boiling at up to 40° C./10 mmHg.

Step (b): Alkylating the Product of Step (a) Using an Aromatic Hydrocarbon

To a glass autoclave liner is added 1 mole equivalent of the lightly branched olefin mixture of step (a), 20 mole equivalents of benzene and 20 wt. % ,based on the olefin mixture, of a shape selective zeolite catalyst (acidic mordenite catalyst Zeocat™ FM-8/25H). The glass liner is sealed inside a stainless steel, rocking autoclave. The autoclave is purged twice with 250 psig N2, and then charged to 1000 psig N2. With mixing, the mixture is heated to 170–190° C. overnight for 14–15 hours at which time it is then cooled and removed from the autoclave. The reaction mixture is filtered to remove catalyst. Benzene is distilled and recycled, volatile impurities also being removed. A clear colorless or nearly colorless liquid product is obtained.

Step (c): Sulfonating the Product of Step (b)

The product of step (b) is sulfonated with an equivalent of chlorosulfonic acid using methylene chloride as solvent. The methylene chloride is distilled away.

Step (d): Neutralizing the Product of Step (c)

The product of step (c) is neutralized with sodium methoxide in methanol and the methanol evaporated to give a crystallinity-disrupted surfactant system, sodium salt mixture.

EXAMPLE 4

Crystallinity Disrupted Surfactant System Prepared Via Skeletal Isomerization of Paraffin Step (a i)

A mixture of n-undecane, n-dodecane, n-tridecane, 1:3:1 wt., is isomerized over Pt-SAPO 11 for a conversion better than 90% at a temperature of about 300–340° C., at 1000 psig under hydrogen gas, with a weight hourly space velocity in the range 2–3 and 30 moles H2/mole hydrocarbon. More detail of such an isomerization is given by S. J. Miller in Microporous Materials, Vol. 2., (1994), 439–449. In further examples the linear starting paraffin mixture can be the same as used in conventional LAB manufacture. Distil to remove any volatiles boiling at up to 40° C./10 mmHg.

Step (a ii)

The paraffin of step (a i) can be dehydrogenated using conventional methods. See, for example, U.S. Pat. No. 5,012,021, Apr. 30, 1991 or U.S. Pat. No. 3,562,797, Feb. 9, 1971. Suitable dehydrogenation catalyst is any of the catalysts disclosed in U.S. Pat. Nos. 3,274,287; 3,315,007; 3,315,008; 3,745,112; 4,430,517; and 3,562,797. For purposes of the present example, dehydrogenation is in accordance with U.S. Pat. No. 3,562,797. The catalyst is zeolite A. The dehydrogenation is conducted in the vapor phase in presence of oxygen (paraffin: dioxygen 1:1 molar). The temperature is in range 450 deg. C.–550 deg. C. Ratio of grams of catalyst to moles of total feed per hour is 3.9.

Step (b): Alkylating the Product of Step (a) Using an Aromatic Hydrocarbon

To a glass autoclave liner is added 1 mole equivalent of the mixture of step (a), 5 mole equivalents of benzene and 20 wt. %, based on the olefin mixture, of a shape selective zeolite catalyst (acidic mordenite catalyst Zeocat™ FM-8/25H). The glass liner is sealed inside a stainless steel, rocking autoclave. The autoclave is purged twice with 250 psig N2, and then charged to 1000 psig N2. With mixing, the mixture is heated to 170–190° C. overnight for 14–15 hours at which time it is then cooled and removed from the autoclave. The reaction mixture is filtered to remove catalyst. Benzene and any unreacted paraffins are distilled and recycled. A clear colorless or nearly colorless liquid product is obtained.

Step (c): Sulfonating the Product of Step (b)

The product of step (b) is sulfonated with sulfur trioxide/air using no solvent See U.S. Pat. No. 3,427,342. The molar ratio of sulfur trioxide to alkylbenzene is from about 1.05:1 to about 1.15:1. The reaction stream is cooled and separated from excess sulfur trioxide.

Step (d): Neutralizing the Product of Step (c)

The product of step (c) is neutralized with a slight excess of sodium hydroxide to give a crystallinity-disrupted surfactant system.

EXAMPLE 5

Crystallinity Disrupted Surfactant System Prepared Via Specific Tertiary Alcohol Mixture from a Grignard Reaction A mixture of 5-methyl-5-undecanol, 6-methyl-6-dodecanol and 7-methyl-7-tridecanol is prepared via the following Grignard reaction. A mixture of 28 g of 2-hexanone, 28 g of 2-heptanone, 14 g of 2-octanone and 100 g of diethyl ether are added to an addition funnel. The ketone mixture is then added dropwise over a period of 1.75 hours to a nitrogen blanketed stirred three neck round bottom flask, fitted with a reflux condenser and containing 350 mL of 2.0 M hexylmagnesium bromide in diethyl ether and an additional 100 mL of diethyl ether. After the addition is complete, the reaction mixture is stirred an additional 1 hour at 2° C. The reaction mixture is then added to 600 g of a mixture of ice and water with stirring. To this mixture is added 228.6 g of 30% sulfuric acid solution. The resulting two liquid phases are added to a separatory funnel. The aqueous layer is drained and the remaining ether layer is washed twice with 600 mL of water. The ether layer is then evaporated under vacuum to yield 115.45 g of the desired alcohol mixture. A 100 g sample of the light yellow alcohol mixture is added to a glass autoclave liner along with 300 mL of benzene and 20 g of a shape selective zeolite catalyst (acidic mordenite catalyst Zeocat™ FM-8/25H). The glass liner is sealed inside a stainless steel, rocking autoclave. The autoclave is purged twice with 250 psig N2, and then charged to 1000 psig N2. With mixing, the mixture is heated to 170° C. overnight for 14–15 hours at which time it is then cooled and removed from the autoclave. The reaction mixture is filtered to remove catalyst and concentrated by distilling off the benzene which is dried and recycled. A clear colorless or nearly colorless lightly branched olefin mixture is obtained.

50 g of the lightly branched olefin mixture provided by dehydrating the Grignard alcohol mixture as above is added to a glass autoclave liner along with 150 mL of benzene and 10 g of a shape selective zeolite catalyst (acidic mordenite catalyst Zeocat™ FM-8/25H). The glass liner is sealed inside a stainless steel, rocking autoclave. The autoclave is purged twice with 250 psig N2, and then charged to 1000 psig N2. With mixing, the mixture is heated to 195° C. overnight for 14–15 hours at which time it is then cooled and removed from the autoclave. The reaction mixture is filtered to remove catalyst and concentrated by distilling off the benzene which is dried and recycled. A clear colorless or nearly colorless liquid product is obtained. The product is distilled under vacuum (1–5 mm of Hg) and the fraction from 95° C.–135° C. is retained.

The retained fraction, i.e., the clear colorless or nearly colorless liquid product, is then sulfonated with a molar equivalent of SO3 and the resulting product is neutralized with sodium methoxide in methanol and the methanol evaporated to give a crystallinity-disrupted surfactant system.

Critical Solubility Temperature Test, or CST Test

The Critical Solubility Temperature Test is a measure of the Critical Solubility Temperature of a surfactant system. The Critical Solubility Temperature, simply stated, is a measure of the temperature a surfactant system at which solubility suddenly and dramatically increases. This temperature is becoming more and more significant with today's trends towards lower and lower wash temperatures. It has been surprisingly found that Critical Solubility Temperature of the alkylarylsulfonate surfactant system of the present invention can be lowered by the number and type of crystallinity-disrupted alkylarylsulfonate surfactants present in the alkylarylsulfonate surfactant system.

The Critical Solubility Temperature is measured in the following manner:

All glassware used is cleaned and dried thoroughly. All temperatures are measured using a calibrated mercury thermometer. The sample weights used are based on the anhydrous form of the solid surfactant or surfactant mixture.

A) Sodium Critical Solubility Temperature—An amount of 99 g of de-ionized water is weighed into a clean, dry beaker equipped with a magnetic stirrer. The beaker is then placed in an ice-water bath until the de-ionized water has been cooled to 0° C. A 1.0 g sample of the solid sodium salt of the surfactant or surfactant mixture for which the Sodium Critical Solubility Temperature is to be measured is then added. The resulting heterogeneous solution is stirred for one hour. If the surfactant sample dissolves within one hour and without any heating to give a clear homogenous solution, the Sodium Critical Solubility Temperature is recorded as ≦0° C. If the surfactant sample does not dissolve within one hour to give a clear homogenous solution, the heterogeneous solution is slowly heated with stirring at a rate of 0.1° C. per minute. The temperature at which the surfactant sample dissolves to give a clear homogenous solution is recorded as the Sodium Critical Solubility Temperature.

B) Calcium Critical Solubility Temperature—An amount of 99 g of de ionized water is weighed into a clean, dry beaker equipped with a magnetic stirrer. The beaker is then placed in an ice-water bath until the de ionized water has been cooled to 0° C. A 1.0 g sample of the solid calcium salt of the surfactant or surfactant mixture for which the Calcium Critical Solubility Temperature is to be measured is then added. The resulting heterogeneous solution is stirred for one hour. If the surfactant sample dissolves within one hour and without any heating to give a clear homogenous solution, the Calcium Critical Solubility Temperature is recorded as ≦0° C. If the surfactant sample does not dissolve within one hour to give a clear homogenous solution, the heterogeneous solution is slowly heated with stirring at a rate of 0.1° C. per minute. The temperature at which the surfactant sample dissolves to give a clear homogenous solution is recorded as the Calcium Critical Solubility Temperature.

Sodium salts of surfactant mixtures here-in are the most common form in which the surfactant mixtures are used. Conversion to calcium salts by simple metathesis e.g., in dilute solution or assisted by a suitable organic solvent, is well known.

Modified SCAS Test

This method is an adaptation of the Soap and Detergent Association semi-continuous activated sludge (SCAS) procedure for assessing the primary biodegradation of alkylbenzene sulphonate. The method involves exposure of the chemical to relatively high concentrations of microorganisms over a long time period (possibly several months). The viability of the micro-organisms is maintained over this period by daily addition of a settled sewage feed. This modified test is also the standard OECD test for inherent biodegradability or 302A. This test was adopted by the OECD on May 12 1981. Details on the "unmodified" SCAS test can be found in "A procedure and Standards for the Determination of the Biodegradability of Alkyl Benzene Sulphonate and Linear Alkylate Sulphonate", Journal of the American Oil Chemists' Society, Vol. 42, p. 986 (1965).

The results obtained with the test surfactant or surfactant system, indicate that it has a high biodegradation potential, and for this reason it is most useful as a test of inherent biodegradability.

The aeration units used are identical to those disclosed in the "unmodified" SCAS test. That is, a Plexiglas tubing 83 mm (3¼ in.) I.D.(internal diameter) Taper the lower end 30° from the vertical to a 13 mm (½ in.) hemisphere at the bottom. 25.4 mm (1 in.) above the joint of the vertical and tapered wall, locate the bottom of a 25.4 mm (1 in.) diameter opening for insertion of the air delivery tube. The total length of the aeration chamber should be at least 600 mm (24 in.). An optional draining hole may be located at the 500 ml level to facilitate sampling. Units are left open to the atmosphere. The air supplied to the aeration units firm a small laboratory scale air compressor. The air is filtered through glass wool or any other suitable medium to remove contamination, oil, etc. The air is also presaturated with water to reduce evaporation losses from the unit. The air is delivered at a rate of 500 ml/minute (1 ft 3/hour). The air is delivered via an 8 mm O.D. (outside diameter), 2 mm I.D. capillary tube. The end of the capillary tube is located 7 mm (¼ in.) from the bottom of the aeration chamber.

Modified SCAS Test—The aeration units are cleaned and fixed in a suitable support. This procedure is conducted at 25°+3° C. Stock solutions of the test surfactant or surfactant system are prepared: the concentration normally required is 400 mg/liter as organic carbon normally gives a test surfactant or surfactant system concentration of 20 mg/liter carbon at the start of each biodegradation cycle if no biodegradation is occurring.

A sample of mixed liquor from an activated sludge plant treating predominantly domestic sewage is obtained. Each aeration unit is filled with 150 ml of mixed liquor and the aeration is started. After 23 hours, aeration is stopped, and the sludge is allowed to settle for 45 minutes. 100 ml of the supernatant liquor is withdrawn. A sample of the settled domestic sewage is obtained immediately before use, and 100 ml are added to the sludge remaining in each aeration unit. Aeration is started anew. At this stage no test materials are added, and the units are fed daily with domestic sewage only until a clear supernatant liquor is obtained on settling. This usually takes up to two weeks, by which time the dissolved organic carbon in the supernatant liquor at the end of each aeration cycle should be less than 12 mg/liter.

At the end of this period the individual settled sludges are mixed, and 50 ml of the resulting composite sludge are added to each unit.

100 ml of settled sewage are added to the aeration units which will be the control units. Add 95 ml of settled sewage plus 5 ml of the appropriate test surfactant or surfactant system stock solution (400 mg/l) to the aeration units which will be the control units. Aeration is started again and continued for 23 hours. The sludge is then allowed to settle for 45 minutes and the supernatant drawn off and analyzed for dissolved organic carbon content. The carbon content (D.O.C.) is analyzed using a SHIMADZU Model TOC-5000 TOC analyzer. This fill and draw procedure is repeated daily throughout the test. Before settling it may be necessary to clean the walls of the units to prevent the accumulation of solids above the level of the liquid. A separate scraper or brush is used for each unit to prevent cross contamination.

Ideally the dissolve organic carbon in the supernatant liquors is determined daily, although less frequent analysis is permissible. Before analysis the liquors are filtered through washed 0.45 micron membrane filters and centrifuged. Temperature of the sample must not exceed 40° C. while it is in the centrifuge.

The dissolved organic carbon results in supernatant liquors of the test aeration units and the control aeration units are plotted against time. As biodegradation is achieved the level found in the test aeration units will approach that found in the control aeration units. Once the difference between the two levels is found to be constant over three consecutive measurements, three further measurements are made and the percentage biodegradation of the test surfactant or surfactant system is calculated by the following equation:

$$\%\ \text{biodegradation} = \frac{100[O_T - (O_1 - O_C)]}{O_T};$$

where

OT=concentration of test surfactant or surfactant system as organic carbon added to the settled sewage at the start of the aeration period.

Ol=concentration of dissolved organic carbon found in the supernatant liquor of the test aeration units at the end of the aeration period.

Oc=concentration of dissolved organic carbon found in the supernatant liquor of the control aeration units.

The level of biodegradation is therefore the percentage elimination of organic carbon.

This modified test provides the following data (as reported on page 7 of the standard OECD test for inherent biodegradability, or 302A) for tetra propylene benzene sulphonate ("TPBS"; see "Surfactant Science Series", Vol. 56, Marcel Dekker, N.Y., 1996, page 43):

| Test surfactant or surfactant system | OT (mg/l) | Ol–Oc (mg/l) | Percentage biodegradation |
|---|---|---|---|
| TPBS | 17.3 | 8.4 | 51.4 |

Numerous variations of the present hand dishwashing compositions are useful. Such variations include:

the hand dishwashing composition which comprises at least about 0.1%, preferably no more than about 10%, more preferably no more than about 5%, more preferably still, no more than about 1%, of a commercial highly branched alkylbenzene sulfonate surfactant. (e.g., TPBS or tetrapropylbenzene sulfonate);

the hand dishwashing composition which comprises a nonionic surfactant at a level of from about 0.5% to about 25% by weight of said detergent composition, and wherein said nonionic surfactant is a polyalkoxylated alcohol in capped or non-capped form having:—a hydrophobic group selected from linear $C_{10}$–$C_{16}$ alkyl, mid-chain $C_1$–$C_3$ branched $C_{10}$–$C_6$ alkyl, guerbet branched $C_{10}$–$O_{16}$ alkyl, and mixtures thereof and—a hydrophilic group selected from 1–15 ethoxylates, 1–15 propoxylates 1–15 butoxylates and mixtures thereof, in capped or uncapped form. (when uncapped, there is also present a terminal primary —OH moiety and when capped, there is also present a terminal moiety of the form —OR wherein R is a $C_1$–$C_6$ hydrocarbyl moiety, optionally comprising a primary or, preferably when present, a secondary alcohol.);

the hand dishwashing composition which comprises an alkyl sulfate surfactant at a level of from about 0.5% to about 25% by weight of said detergent composition, wherein said alkyl sulfate surfactant has a hydrophobic group selected from linear $C_{10}$–$C_{18}$ alkyl, mid-chain $C_1$–$C_3$ branched $C_{10}$–$C_{18}$ alkyl, guerbet branched $C_{10}$–$C_{18}$ alkyl, and mixtures thereof and a cation selected from Na, K and mixtures thereof;

the hand dishwashing composition which comprises an alkyl(polyalkoxy)sulfate surfactant at a level of from about 0.5% to about 25% by weight of said detergent composition, wherein said alkyl(polyalkoxy)sulfate surfactant has—a hydrophobic group selected from linear $C_{10}$–$C_{16}$ alkyl mid-chain $C_1$–$C_3$ branched $C_{10}$–$C_{16}$ alkyl, guerbet branched $C_{10}$–$C_{16}$ alkyl, and mixtures thereof and—a (polyalkoxy)sulfate hydrophilic group selected from 1–15 polyethoxysulfate, 1–15 polypropoxysulfate, 1–15 polybutoxysulfate, 1–15 mixed poly(ethoxy/propoxy/butoxy)sulfates, and mixtures thereof, in capped or uncapped form; and—a cation selected from Na, K and mixtures thereof;

It is preferred that when the hand dishwashing composition comprises an alkyl(polyalkoxy)sulfate surfactant which has a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof; and a (polyalkoxy) sulfate hydrophilic group selected from 1–15 polyethoxysulfate, 1–15 polypropoxysulfate, 1–15 polybutoxysulfate, 1–15 mixed poly(ethoxy/propoxy/butoxy)sulfates, and mixtures thereof, in capped or uncapped form; and a cation selected from Na, K and mixtures thereof.

It is preferred that when the hand dishwashing composition comprises a nonionic surfactant, it is a polyalkoxylated alcohol in capped or non-capped form has a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof; and a hydrophilic group selected from 1–15 ethoxylates, 1–15 propoxylates 1–15 butoxylates and mixtures thereof, in capped or uncapped form. When uncapped, there is also present a terminal primary —OH moiety and when capped, there is also present a terminal moiety of the form —OR wherein R is a $C_1$–$C_6$ hydrocarbyl moiety, optionally comprising a primary or, preferably when present, a secondary alcohol.

It is preferred that when the band dishwashing composition comprises an alkyl sulfate surfactant which has a hydrophobic group selected from linear $C_{10}$–$C_{16}$ alkyl, mid-chain $C_1$–$C_3$ branched $C_{10}$–$C_{18}$ alkyl, guerbet branched $C_{10}$–$C_{16}$ alkyl, and mixtures thereof and a cation selected from Na, K and mixtures thereof The hand dishwashing compositions of the present invention can be used or applied by hand and/or can be applied in unitary or freely alterable dosage, or by automatic dispensing means, They can be used in aqueous or non-aqueous cleaning systems. They can have a wide range of pH, for example from about 2 to about 12 or higher, though alkaline detergent compositions having a pH of from about 8 to about 11 are among the preferred embodiments, and they can have a wide range of alkalinity reserve. Both high-foaming and low-foaming types are encompassed, as well as types for use in all known aqueous and non aqueous consumer product cleaning processes.

The hand dishwashing compositions can be in any conventional form, namely, in the form of a liquid, powder, agglomerate, paste, tablet, bar, gel, liqui-gel microemulsion, liquid crystal, or granule.

Conventional Hand Dishwashing Adjuncts and Methods:

The precise nature of these additional components, and levels of incorporation thereof, will depend on the physical form of the composition and the nature of the cleaning operation for which it is to be used.

Levels of conventional hand dishwashing adjuncts are from about 0.00001% to about 99.9%, by weight of the composition. Use levels of the overall compositions can vary widely depending on the intended application, ranging for example from a few ppm in solution to so-called "direct application" of the neat cleaning composition to the surface to be cleaned.

Preferably the conventional hand dishwashing adjunct is selected from the group consisting of builders, detersive enzymes, surfactants other than the crystallinity-disrupted alkylarylsulfonate surfactants, typically selected from anionic, cationic, amphoteric, zwitterionic, nonionic and mixtures thereof, at least partially water-soluble or water dispersible polymers, abrasives, bactericides, tarnish inhibitors, dyes, solvents, hydrotropes, perfumes, thickeners, antioxidants, processing aids, suds boosters, suds suppressors, buffers, anti-fungal agents, mildew control agents, insect repellents, anti-corrosive aids, chelants and mixtures thereof. More preferably the conventional cleaning adjunct comprises one or more of:

Consumer product cleaning compositions are described in the "Surfactant Science Series", Marcel Dekker, New York, Volumes 1–67 and higher. Liquid compositions in particular are described in detail in the Volume 67, "Liquid Detergents" Ed. Kuo-Yann Lai, 1997, ISBN 0-8247-9391-9 incorporated herein by reference. More classical formulations, especially granular types, are described in "Detergent Manufacture including Zeolite Builders and Other New Materials", Ed. M. Sittig, Noyes Data Corporation, 1979 incorporated by reference. See also Kirk Othmer's Encyclopedia of Chemical Technology.

Detergents with enduring perfume (see for example U.S. Pat. No. 5,500,154; WO 96/02490) are increasingly popular and there use in conjunction with the present surfactant mixtures is envisioned.

In general, a conventional hand dishwashing adjuncts is any material required to transform a composition containing only the minimum essential ingredients (herein the essential crystallinity-disrupted alkylarylsulfonate surfactants) into a composition useful for hand dishwashing. In preferred embodiments, conventional hand dishwashing adjuncts are easily recognizable to those of skill in the art as being absolutely characteristic of cleaning products.

The precise nature of these additional components, and levels of incorporation thereof, will depend on the physical form of the composition and the nature of the cleaning operation for which it is to be used.

Conventional hand dishwashing adjunct include builders, surfactants, enzymes, and polymers, and the like. Other adjuncts herein can include suds boosters, suds suppressors (antifoams) and the like, diverse active ingredients or specialized materials such as dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, pro-perfumes, perfumes, solubilizing agents, carriers, processing aids, pigments, and, for liquid formulations, solvents, as described in detail hereinafter.

Quite typically, the compositions herein may require several adjuncts, though certain simply formulated products may require only, one adjunct. A comprehensive list of suitable laundry or cleaning adjunct materials and methods can be found in U.S. Provisional Patent application No. 60/053,318 filed Jul. 21, 1997 and assigned to Procter & Gamble.

The crystallinity-disrupted alkylarylsulfonate surfactants of the present invention can be used in a wide range of hand dishwashing formulations. This novel surfactant system can be used as a total or partial replacement of conventional LAS in existing hand dishwashing compositions. Formulations where the crystallinity-disrupted alkylarylsulfonate surfactants of the present invention could be used as a supplement to the existing surfactant system or as a total or partial replacement for LAS in the surfactant system include, but not limited to: WO 98/12290; U.S. Pat. No. 5,728,668; WO 98/05745; U.S. Pat. No. 5,756,441; U.S. Pat. No. 5,714,454; U.S. Pat. No. 5,712,241; U.S. Pat. No. 5,707,955; U.S. Pat. No. 4,133,779; WO 97/47717; U.S. Pat. No. 5,688,754; U.S. Pat. No. 5,665,689; WO 9738073; U.S. Pat. No. 5,696,073; WO 97/38071; WO 97/00930 A; GB 2,292,562 A; U.S. Pat. No. 5,376,310; U.S. Pat. No. 5,269,974; U.S. Pat. No. 5,230,823; U.S. Pat. No. 4,923,635; U.S. Pat. No. 4,681,704; U.S. Pat. No. 4,316,824; U.S. Pat. No. 4,133,779; U.S. Pat. No. 5,700,773; WO 9735947; WO 97/34976; U.S. Pat. No. 5,629,279; WO 9715650; U.S. Pat. No. 5,616,548; U.S. Pat. No. 5,610,127; U.S. Pat. No. 5,565,421; WO 96/31586; U.S. Pat. No. 5,561,106; U.S. Pat. No. 5,552,089; WO 96/22347; U.S. Pat. No. 5,503,779; U.S. Pat. No. 5,480,586; EP 573329; U.S. Pat. No. 5,382,386; EP 487169; U.S. Pat. No. 5,096,622; EP 431050; U.S. Pat. No. 5,102,573; U.S. Pat. No. 4,772,425; U.S. Pat. No. 4,725,337; EP 228797; U.S. Pat. No. 4,556,509; U.S. Pat. No. 4,454,060; U.S. Pat. No. 4,554,098; U.S. Pat. No. 4,430,237; U.S. Pat. No. 4,877,546; U.S. Pat. No. 4,064,076; U.S. Pat. No. 4,101,456; U.S. Pat. No. 3,944,663; U.S. Pat. No. 4,040,989; U.S. Pat. No. 4,102,826; U.S. Pat. No. 5,767,051; U.S. Pat. No. 5,780,417; WO 97/26315; U.S. Pat. No. 5,290,482; U.S. Pat. No. 3,954,679; U.S. Pat. No. 5,700,331; U.S. Pat. No. 5,679,877; U.S. Pat. No. 5,565,419; WO 98/22569; U.S. Pat. No. 5,736,496; U.S. Pat. No. 5,733,560; U.S. Pat. No. 574,169; U.S. Pat. No. 5,733,860; U.S. Pat. No. 5,741,770; U.S. Pat. No. 5,719,114; U.S. Pat. No. 5,604,195; EP 848749; EP 839177; U.S. Pat. No. 5,646,104; U.S. Pat. No. 5,580,848; EP 781324; U.S. Pat. No. 5,415,812; U.S. Pat. No. 5,435,936; U.S. Pat. No. 5,082,584; U.S. Pat. No. 5,393,468;

Detersive surfactants—The instant compositions desirably include a detersive surfactant used as a co-surfactant with the essential surfactant mixtures. Since the present invention is surfactant-related, in the descriptions of the preferred embodiments of the detergent compositions of the invention, surfactant materials are described and accounted for separately from nonsurfactant adjuncts. Detersive surfactants are extensively illustrated in U.S. Pat. No. 3,929,678, Dec. 30, 1975 Laughlin, et al, and U.S. Pat. No. 4,259,217, Mar. 31, 1981, Murphy; in the series "Surfactant Science", Marcel Dekker, Inc., New York and Basel; in "Handbook of Surfactants", M. R. Porter, Chapman and Hall, 2nd Ed., 1994; in "Surfactants in Consumer Products", Ed. J. Falbe, Springer-Verlag, 1987; and in numerous detergent-related patents assigned to Procter & Gamble and other detergent and consumer product manufacturers.

The detersive surfactant herein includes anionic, nonionic, cationic, zwitterionic or amphoteric types of surfactant known for use as cleaning agents, but does not include completely foam-free or completely insoluble surfactants (though these may be used as optional adjuncts).

In more detail, detersive surfactants useful herein, suitably include: (1) conventional alkylbenzene sulfonates, including the hard (ABS, TPBS) or linear types and made by known processe such as various HF or solid HF e.g., DETAL® (UOP) process, or made by using other Lewis Acid catalysts e.g., $AlCl_3$, or made using acidic silica/alumina or made from chlorinated hydrocarbons; (2) olefin sulfonates, including α-olefin sulfonates and sulfonates derived from fatty acids and fatty esters; (3) alkyl or alkenyl sulfosuccinates, including the diester and half-ester types as well as sulfosuccinamates and other sulfonate/carboxylate surfactant types such as the sulfosuccinates derived from ethoxylated alcohols and alkanolamides; (4) paraffin or alkane sulfonate- and alkyl or alkenyl carboxysulfonate-types including the product of adding bisulfite to alpha olefins; (5) alkylnaphthalenesulfonates; (6) alkyl isethionates and alkoxypropanesulfonates, as well as fatty isethionate esters, fatty esters of ethoxylated isethionate and other ester sulfonates such as the ester of 3-hydroxypropanesulfonate or AVANEL S types; (7) benzene, cumene, toluene, xylene, and naphthalene sulfonates, useful especially for their hydrotroping properties; (8) alkyl ether sulfonates; (9) alkyl amide sulfonates; (10) α-sulfo fatty acid salts or esters and internal sulfo fatty acid esters; (11) alkylglycerylsulfonates; (12) ligninsulfonates; (13) petroleum sulfonates, sometimes known as heavy alkylate sulfonates; (14) diphenyl oxide disulfonates; (15) linear or branched alkylsulfates or alkenyl sulfates; (16) alkyl or alkylphenol alkoxylate sulfates and the corresponding polyalkoxylates, sometimes known as alkyl ether sulfates, as well as the alkenylalkoxysulfates or alkenylpolyalkoxy sulfates; (17) alkyl amide sulfates or alkenyl amide sulfates, including sulfated alkanolamides and their alkoxylates and polyalkoxylates; (18) sulfated oils, sulfated alkylglycerides, sulfated alkylpolyglycosides or sulfated sugar-derived surfactants; (19) alkyl alkoxycarboxylates and alkylpolyalkoxycarboxylates, including galacturonic acid salts; (20) alkyl ester carboxylates and alkenyl ester carboxylates; (21) alkyl or alkenyl carboxylates, especially conventional soaps and α,ω-dicarboxylates, including also the alkyl- and alkenylsuccinates; (22) alkyl or alkenyl amide alkoxy- and polyalkoxy-carboxylates; (23) alkyl and alkenyl amidocarboxylate surfactant types, including the sarcosinates, taurides, glycinates, aminopropionates and iminopropionates; (24) amide soaps, sometimes referred to as fatty acid cyanamides; (25) alkylpolyaminocarboxylates; (26) phosphorus-based surfactants, including alkyl or alkenyl phosphate esters, alkyl ether phosphates including their alkoxylated derivatives, phopshatidic acid salts, alkyl phosphonic acid salts, alkyl di(polyoxyalkylene alkanol) phosphates, amphoteric phosphates such as lecithins; and phosphate/carboxylate, phosphate/sulfate and phosphate/sulfonate types; (27) Pluronic- and Tetronic-type nonionic surfactants; (28) the so-called EO/PO Block polymers, including the diblock and triblock EPE and PEP types; (29) fatty acid polyglycol esters; (30) capped and non-capped alkyl or alkylphenol ethoxylates, propoxylates and butoxylates including fatty alcohol polyethyleneglycol ethers; (31) fatty alcohols, especially where useful as viscosity-modifying surfactants or present as unreacted components of other surfactants; (32) N-alkyl polyhydroxy fatty acid amides, especially the alkyl N-alkylglucamides; (33) nonionic surfactants derived from mono- or polysaccharides or sorbitan, especially the alkylpolyglycosides, as well as sucrose fatty acid esters; (34) ethylene glycol-, propylene glycol-, glycerol- and polyglyceryl-esters and their alkoxylates, especially glycerol ethers and the fatty acid/glycerol monoesters and diesters; (35) aldobionamide surfactants; (36) alkyl succinimide nonionic surfactant types; (37) acetylenic alcohol surfactants, such as the SURFYNOLS; (38) alkanolamide surfactants and their alkoxylated derivatives including fatty acid alkanolamides and fatty acid alkanolamide polyglycol ethers; (39) alkylpyrrolidones; (40) alkyl amine oxides, including alkoxylated or polyalkoxylated amine oxides and amine oxides derived from sugars; (41) alkyl phosphine oxides; (42) sulfoxide surfactants; (43) amphoteric sulfonates, especially sulfobetaines; (44) betaine-type amphoterics, including aminocarboxylate-derived types; (45) amphoteric sulfates such as the alkyl ammonio polyethoxysulfates; (46) fatty and petroleum-derived alkylamines and amine salts; (47) alkylimidazolines; (48) alkylamidoamines and their alkoxylate and polyalkoxylate derivatives; and (49) conventional cationic surfactants, including water-soluble alkyltrimethylammonium salts. Moreover, more unusual surfactant types are included, such as: (50) alkylamidoamine oxides, carboxylates and quaternary salts; (51) sugar-derived surfactants modeled after any of the hereinabove-referenced more conventional nonsugar types; (52) fluorosurfactants; (53) biosurfactants; (54) organosilicon or fluorocarbon surfactants; (55) gemini surfactants, other than the above-referenced diphenyl oxide disulfonates, including those derived from glucose; (56) polymeric surfactants including amphopolycarboxyglycinates; and (57) bolaform surfactants; in short any surfactant known for aqueous or non-aqueous cleaning.

In any of the above detersive surfactants, hydrophobe chain length is typically in the general range $C_8$–$C_{20}$, with chain lengths in the range $C_8$–$C_{18}$ often being preferred, especially when laundering is to be conducted in cool water. Selection of chainlengths and degree of alkoxylation for conventional purposes are taught in the standard texts. When the detersive surfactant is a salt, any compatible cation may be present, including H (that is, the acid or partly acid form of a potentially acidic surfactant may be used), Na, K, Mg, ammonium or alkanolammonium, or combinations of cations. Mixtures of detersive surfactants having different charges are commonly preferred, especially anionic/cationic, anionic/nonionic, anionic/nonionic/cationic, anionic/nonionic/amphoteric, nonionic/cationic and nonionic/amphoteric mixtures. Moreover, any single detersive surfactant may be substituted, often with desirable results for cool water washing, by mixtures of otherwise similar detersive surfactants having differing chainlengths, degree of unsaturation or branching, degree of alkoxylation (especially ethoxylation), insertion of substituents such as ether oxygen atoms in the hydrophobes, or any combinations thereof.

Preferred among the above-identified detersive surfactants are: acid, sodium and ammonium $C_9$–$C_{20}$ linear alkylbenzene sulfonates, particularly sodium linear secondary alkyl $C_{10}$–$C_{15}$ benzenesulfonates though in some regions ABS may be used (1); olefinsulfonate salts, (2), that is, material made by reacting olefins, particularly $C_{10}$–$C_{20}$ α-olefins, with sulfur trioxide and then neutralizing and hydrolyzing the reaction product; sodium and ammonium $C_7$–$C_{12}$ dialkyl sulfosuccinates, (3); alkane monosulfonates, (4), such as those derived by reacting $C_8$–$C_{20}$ α-olefins with sodium bisulfite and those derived by reacting paraffins with $SO_2$ and $Cl_2$ and then hydrolyzing with a base to form a random sulfonate; α-Sulfo fatty acid salts or esters, (10); sodium alkylglycerylsulfonates, (11), especially those ethers of the higher alcohols derived from tallow or coconut oil and synthetic alcohols derived from petroleum; alkyl or alkenyl sulfates, (15), which may be primary or secondary, saturated or unsaturated, branched or unbranched. Such compounds when branched can be random or regular. When secondary, they preferably have formula $CH_3(CH_2)_x(CHOSO_3^-M^+)CH_3$ or $CH_3(CH_2)_y(CHOSO_3^-M^+)CH_2CH_3$ where x and (y+1) are integers of at least 7, preferably at least 9 and M is a water-soluble cation, preferably sodium. When unsaturated, sulfates such as oleyl sulfate are preferred, while the sodium and ammonium alkyl sulfates, especially those produced by sulfating $C_8$–$C_{18}$ alcohols, produced for example from tallow or coconut oil are also useful; also preferred are the alkyl or alkenyl ether sulfates, (16), especially the ethoxy sulphates having about 0.5 moles or higher of ethoxylation, preferably from 0.5–8; the alkylethercarboxylates, (19), especially the EO 1–5 ethoxycarboxylates; soaps or fatty acids (21), preferably the more water-soluble types; aminoacid-type surfactants, (23), such as sarcosinates, especially oleyl sarcosinate; phosphate esters, (26); alkyl or alkylphenol ethoxylates, propoxylates and butoxylates, (30), especially the ethoxylates "AE", including the so-called narrow peaked alkyl ethoxylates and $C_6$–$C_{12}$ alkyl phenol alkoxylates as well as the products of aliphatic primary or secondary linear or branched $C_8$–$C_{18}$ alcohols with ethylene oxide, generally 2–30 EO; N-alkyl polyhydroxy fatty acid amides especially the $C_{12}$–$C_{18}$ N-methylglucamides, (32), see WO 9206154, and N-alkoxy polyhydroxy fatty acid amides, such as $C_{10}$–$C_{18}$ N-(3-methoxypropyl) glucamide while N-propyl through N-hexyl $C_{12}$–$C_{18}$ glucamides can be used for low sudsing; alkyl polyglycosides, (33); amine oxides, (40), preferably alkyldimethylamine N-oxides and their dihydrates; sulfobetaines or "sultaines", (43); betaines (44); and gemnini surfactants.

Cationic surfactants suitable for use in the present invention include those having a long-chain hydrocarbyl group. Examples of such cationic co-surfactants include the ammonium co-surfactants such as alkyldimethylammonium halogenides, and those co-surfactants having the formula:

$$[R^2(OR^3)_y][R^4(OR^3)_y]_2R^5N^{+X^-}$$

wherein $R^2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Examples of other suitable cationic surfactants are described in following documents, all of which are incorporated by reference herein in their entirety M. C. Publishing Co., McCutcheon's, Detergents & Emulsifiers, (North American edition 1997); Schwartz, et al., Surface Active Agents, Their Chemistry and Technology, New York: Interscience Publishers, 1949; U.S. Pat. No. 3,155,591; U.S. Pat. No. 3,929,678; U.S. Pat. No. 3,959,461 U.S. Pat. No. 4,387,090 and U.S. Pat. No. 4,228,044.

Examples of suitable cationic surfactants are those corresponding to the general formula:

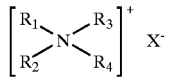

wherein $R_1$, $R_2$, $R_3$, and $R_4$ are independently selected from an aliphatic group of from 1 to about 22 carbon atoms or an aromatic, alkoxy, polyoxyalkylene, alkylamido, hydroxyalkyl, aryl or alkylaryl group having up to about 22 carbon atoms; and X is a salt-forming anion such as those selected from halogen, (e.g. chloride, bromide), acetate, citrate, lactate, glycolate, phosphate nitrate, sulfate, and alkylsulfate radicals. The aliphatic groups can contain, in addition to carbon and hydrogen atoms, ether linkages, and other groups such as amino groups. The longer chain aliphatic groups, e.g., those of about 12 carbons, or higher, can be saturated or unsaturated. Preferred is when $R_1$, $R_2$, $R_3$, and $R_4$ are independently selected from C1 to about C22 alkyl. Especially preferred are cationic materials containing two long alkyl chains and two short alkyl chains or those containing one long alkyl chain and three short alkyl chains. The long alkyl chains in the compounds described in the previous sentence have from about 12 to about 22 carbon atoms, preferably from about 16 to about 22 carbon atoms, and the short alkyl chains in the compounds described in the previous sentence have from 1 to about 3 carbon atoms, preferably from 1 to about 2 carbon atoms.

Suitable levels of cationic detersive surfactant herein are from about 0.1% to about 20%, preferably from about 1% to about 15%, although much higher levels, e.g., up to about 30% or more, may be useful especially in nonionic: cationic (i.e., limited or anionic-free) formulations. One possible use of cationic surfactants is as grease release agents. Cationic surfactants can be on their own or in combination with solvents and/or solubilizing agents. See U.S. Pat. No. 5,552,089.

Another type of useful surfactants are the so-called dianionics. These are surfactants which have at least two anionic groups present on the surfactant molecule. Some suitable dianionic surfactants are further described in U.S. Ser. No. 60/020,503, now abandoned, Ser. No. 60/020,832, now abandoned, Ser. No. 60/023493, now abandoned, Ser. No. 60/023,527, now abandoned, WO 98/00498, WO 98/00503, U.S. Pat. No. 5,958,858, WO 98/05742, WO 98/05749, the disclosures of which are incorporated herein by reference.

Additionally and preferably, the surfactant may be a midchain branched alkyl slufate, midchain branched alkyl alkoxylate, or midchain branched alkyl alkoxylate sulfate. These surfactants are further described in WO 99/19434, WO 99/18929, WO 99/19435, EP 1 023 042, WO 99/19448, and EP 1 023 431. Other suitable mid-chain branched surfactants can be found in WO 97/39087, WO 97/39088, WO 97/39091, WO 98/23712, WO 97/38972, WO 97/39089, and WO 97/39090. Mixtures of these branched surfactants with conventional linear surfactants are also suitable for use in the present compositions.

Combinations of surfactants are also envisaged. One such combination would be the modified alkylbenzene sulfonate surfactants of the present invention forming a negatively charged complex with an alkylene carbonate surfactant. See U.S. Pat. No. 5,736,496. Alternatively these alkylene carbonate surfactants can be combines with the modified alkylbenzene sulfonate surfactants of the present and not form a negatively charged complex. Such as the compositions in U.S. Pat. No. 5,733,860. In either type of composition suitable alkylene carbonate surfactants include those of the formula:

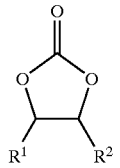

wherein R1 is a Cn alkyl group, R2 is H or is a Cm alkyl group, with n+m being a number from 11–14;

Another possible combination with the modified alkylbenzene sulfonate surfactant is with a monoalkyl succinamate, more preferably with from about 0.5 to about 6% by weight of a $C_{10}$ to $C_{18}$ monoalkyl succinamate, wherein the alkyl group may be ethoxylated with up to 8 moles of ethylene oxide, the monoalkyl succinamate has the structure:

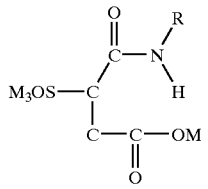

where R is an aliphatic radical, of from 10 to 18 on atoms, and M is a cation, selected from the group consisting of sodium, potassium, ammonium and alkanolamine. See U.S. Pat. No. 5,480,596.

Suitable levels of anionic detersive surfactants herein are in the range from about 1% to about 50% or higher, preferably from about 2% to about 30%, more preferably still, from about 5% to about 20% by weight of the detergent composition.

Suitable levels of nonionic detersive surfactant herein are from about 1% to about 40%, preferably from about 2% to about 30%, more preferably from about 5% to about 20%.

Desirable weight ratios of anionic:nonionic surfactants in combination include from 1.0:9.0 to 1.0:0.25, preferably 1.0:1.5 to 1.0:0.4.

Desirable weight ratios of anionic:cationic surfactants in combination include from 50:1 to 5:1, more preferably 35:1 to 15:1.

Suitable levels of cationic detersive surfactant herein are from about 0.1% to about 20%, preferably from about 1% to about 15%, although much higher levels, e.g., up to about 30% or more, may be useful especially in nonionic:cationic (i.e., limited or anionic-free) formulations.

Amphoteric or zwitterionic detersive surfactants when present are usually useful at levels in the range from about 0.1% to about 20% by weight of the detergent composition. Often levels will be limited to about 5% or less, especially when the amphoteric is costly.

Surfactant

The composition will preferably contain at least about 0.01%, more preferably at least about 0.1%, even more preferably still at least about 0.2%, even more preferably still, at least about 0.5% by weight of said composition of surfactant. The composition will also preferably contain no more than about 90%, more preferably no more than about 70%, even more preferably, no more than about 60%, even more preferably, no more than about 35% by weight of said composition of surfactant.

The anionic surfactants useful in the present invention are preferably selected from the group consisting of, linear alkylbenzene sulfonate, alpha olefin sulfonate, paraffin sulfonates, alkyl ester sulfonates, alkyl sulfates, alkyl alkoxy sulfate, alkyl sulfonates, alkyl alkoxy carboxylate, alkyl alkoxylated sulfates, sarcosinates, taurinates, and mixtures thereof.

When present, anionic surfactant will be present typically in an effective amount. More preferably, the composition may contain at least about 0.5%, more preferably at least about 5%, even more preferably still, at least about 10% by weight of said composition of anionic surfactant. The composition will also preferably contain no more than about 90%, more preferably no more than about 50%, even more preferably, no more than about 30% by weight of said composition of anionic surfactant.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula ROSO3M wherein R preferably is a C10–C24 hydrocarbyl, preferably an alkyl or hydroxyalkyl having a C10–C20 alkyl component, more preferably a C12–C18 alkyl or hydroxyalkyl, and M is H or a cation, e.g., an alkali (Group IA) metal cation (e.g., sodium, potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of C12–16 are preferred for lower wash temperate (e.g., below about 50° C.) and C16–18 alkyl chains are preferred for higher wash temperatures (e.g., above about 50° C.).

Alkyl alkoxylated sulfate surfactants are another category of useful anionic surfactant. These surfactants are water soluble salts or acids typically of the formula RO(A) mSO3M wherein R is an unsubstituted C10–C24 alkyl or hydroxyalkyl group having a C10–C24 alkyl component, preferably a C12–C20 alkyl or hydroxyalkyl, more preferably C12–C18 alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, etc.), ammonium or substituted-ammonium cation. Alkyl ethoxylated sulfates as well as alkyl propoxylated sulfates are contemplated herein. Specific examples of substituted ammonium cations include methyl, dimethyl-, trimethylammonium and quaternary ammonium cations, such as tetramethyl-ammonium, dimethyl piperidinium and cations derived from alkanolamines, e.g. monoethanolamine, diethanolamine, and triethanolamine, and mixtures thereof Exemplary surfactants are C12–C18 alkyl polyethoxylate (1.0) sulfate, C12–C18 alkyl polyethoxylate (2.25) sulfate, C12–C18 alkyl polyethoxylate (3.0) sulfate, and C12–C18 alkyl polyethoxylate (4.0) sulfate wherein M is conveniently selected from sodium and potassium. Surfactants for use herein can be made from natural or synthetic alcohol feedstocks. Chain lengths represent average hydrocarbon distributions, including branching. The anionic surfactant component may comprise alkyl sulfates and alkyl ether sulfates derived from conventional alcohol sources, e.g., natural alcohols, synthetic alcohols such as those sold under the trade name of NEODOL™, ALFOL™, LIAL™, LUTENSOL™ and the like. Alkyl ether sulfates are also known as alkyl polyethoxylate sulfates.

Examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

One type of anionic surfactant which can be utilized encompasses alkyl ester sulfonates. These are desirable because they can be made with renewable, non-petroleum resources. Preparation of the alkyl ester sulfonate surfactant component can be effected to according to known methods disclosed in the technical literature. For instance, linear esters of C8–C20 carboxylic acids can be sulfonated with gaseous SO3 according to "The Journal of the American Oil Chemists Society," 52 (1975), pp. 323–329. Suitable starting materials would include natural fatty substances as derived from tallow, palm, and coconut oils, etc.

The preferred alkyl ester sulfonate surfactant, especially for laundry applications, comprises alkyl ester sulfonate surfactants of the structural formula:

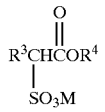

wherein R3 is a C8–C20 hydrocarbyl, preferably an alkyl, or combination thereof, R4 is a C1–C6 hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperdinium, and cations derived from alkanolamines, e.g. monoethanol-amine, diethanolamine, and triethanolamine. Preferably, R3 is C10–C16 alkyl, and R4 is methyl, ethyl or isopropyl. Especially preferred are the methyl ester sulfonates wherein R3 is C14–C16 alkyl.

Other anionic surfactants useful for detersive purposes can also be included in the compositions hereof. These can include salts (including, for example, sodium, potassium, ammonium, and substituted ammonium salts such as mono-, di- and triethanolamine salts) of soap, C9–C20 linear alkylbenzenesulphonates, C8–C22 primary or secondary alkanesulphonates, C8–C24 olefinsulphonates, sulphonated polycarboxylic acids prepared by sulphonation of the pyrolyzed product of alkaline earth metal citrates, e.g., as described in British patent specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated C12–C18 monoesters) diesters of sulfosuccinate (especially saturated and unsaturated C6–C14 diesters), N-acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula RO(CH2CH20)kCH2COO—M+ wherein R is a C8–C22 alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23. Nonionic Detergent Surfactants—Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants include: alkyl ethoxylate, alkanoyl glucose amide, C12–C18 alkyl ethoxylates ("AE") including the so-called narrow peaked alkyl ethoxylates and C6–C12 alkyl phenol alkoxylates (especially ethoxylates and mixed ethoxy/propoxy), and mixtures thereof When present, nonionic surfactant will be present typically in an effective amount. More preferably, the composition may contain at least about 0.1%, more preferably at least about 0.2%, even more preferably still, at least about 0.5% by weight of said composition of nonionic surfactant. The composition will also preferably contain no more than about 20% more preferably no more than about 15%, even more preferably, no more than about 10% by weight of said composition of nonionic surfactant.

The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal® CO-630, marketed by the GAF Corporation; and Triton® X-45, X-114, X-100, and X-102, all marketed by the Rohm & Haas Company. These compounds are commonly referred to as alkyl phenol alkoxylates, (e.g., alkyl phenol ethoxylates).

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol® 15-S-9 (the condensation product of C11–C15 linear secondary alcohol with 9 moles ethylene oxide), Tergitol® 24-L-6 NMW (the condensation product of C12–C14 primary alcohol with 6 moles ethylene oxide with a narrow molecular weight distribution), both marketed by Union Carbide Corporation; Neodol® 45-9 (the condensation product of C14–C15 linear alcohol with 9 moles of ethylene oxide), Neodol® 23-6.5 (the condensation product of C12–C13 linear alcohol with 6.5 moles of ethylene oxide), Neodol® 45-7 (the condensation product of C14–C15 linear alcohol with 7 moles of ethylene oxide), Neodol® 45-4 (the condensation product of C14–C15 linear alcohol with 4 moles of ethylene oxide), marketed by Shell Chemical Company, and Kyro® EOB (the condensation product of C13–C15 alcohol with 9 moles ethylene oxide), marketed by The Procter & Gamble Company. Other commercially available nonionic surfactants include Dobanol 91-8® marketed by Shell Chemical Co. and Genapol UD080® marketed by Hoechst. This category of nonionic surfactant is referred to generally as "alkyl ethoxylates."

The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic® surfactants, marketed by BASF.

The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic® compounds, marketed by BASF.

Examples of ethylene oxide-propylene oxide block co-polymers suitable for uses herein are described in greater detail in Pancheri/Mao; U.S. Pat. No. 5,167,872; Issued Dec. 2, 1992. This patent is incorporated herein by reference.

The preferred alkylpolyglycosides have the formula $$R2O(CnH2nO)t(\text{glycosyl})x$$

wherein R2 is selected from the group consisting of alkyl, alkyl-phenyl, hydroxyalkyl, hydroxyalkylphenyl, and mixtures thereof in which the all groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyl, decyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexa-glucosides.

Another type of suitable nonionic surfactant comprises a mixture (herein after referred to as ethoxylated glycerol type compound) which is a mixture of a fully esterified ethoxylated polyhydric alcohol, a partially esterified ethoxylated polyhydric alcohol and a nonesterified ethoxylated polyhydric alcohol, wherein the preferred polyhydric alcohol is glycerol, and the compound is formula (I)

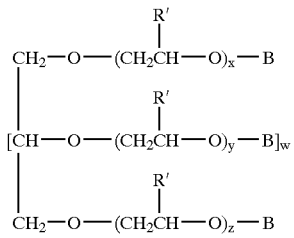

and formula (II)

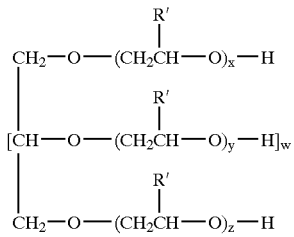

wherein w equals one to four, most preferably one. B is selected from the group consisting of hydrogen or a group represented by:

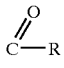

wherein R is selected from the group consisting of alkyl group having 6 to 22 carbon atoms, more preferably 11 to 15 carbon atoms and alkenyl groups having 6 to 22 carbon atoms, more preferably 11 to 15 carbon atoms, wherein a hydrogenated tallow alkyl chain or a coco alkyl chain is most preferred, wherein at least one of the B groups is represented by said

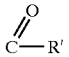

and R' is selected from the group consisting of hydrogen and methyl groups; x, y and z have a value between 0 and 60, more preferably 0 to 40, provided that (x+y+z) equals 2 to 100, preferably 4 to 24 and most preferably 4 to 19, wherein in Formula (I) the wt. ratio of monoester/diester/triester is 45 to 90/5 to 40/1 to 20, more preferably 50 to 90/9 to 32/1 to 12, wherein the wt. ratio of Formula (I) to Formula (II) is a value between 3 to 0.02, preferably 3 to 0.1, most preferably 1.5 to 0.2, wherein it is most preferred that there is more of Formula (II) than Formula (I) in the mixture that forms the compound.

The ethoxylated glycerol type compound which may be used in the in the instant composition are manufactured by the Kao Corporation and sold under the trade name Levenol such as Levenol F-200 which has an average EO of 6 and a molar ratio of coco fatty acid to glycerol of 0.55 or Levenol V501/2 which has an average EO of 17 and a molar ratio of tallow fatty acid to glycerol of 1.0. It is preferred that the molar ratio of the fatty acid to glycerol is less than 1.7, more preferably less than 1.5 and most preferably less than 1.0. The ethoxylated glycerol type compound has a molecular weight of 400 to 1600, and a pH (50 grams/liter of water) of 5–7. The Levenol compounds are substantially non irritant to human skin and have a primary biodegradabillity higher than 90% as measured by the Wickbold method Bias-7d. Two examples of the Levenol compounds are Levenol V-501/2 which has 17 ethoxylated groups and is derived from tallow fatty acid with a fatty acid to glycerol ratio of 1.0 and a molecular weight of 1465 and Levenol F-200 has 6 ethoxylated groups and is derived from coco fatty acid with a fatty acid to glycerol ratio of 0.55. Both Levenol F-200 and Levenol V-501/2 are composed of a mixture of Formula (I) and Formula (II). The Levenol compounds has ecoxicity values of algae growth inhibition >100 mg/liter; acute toxicity for Daphniae >100 mg/liter and acute fish toxicity >100 mg/liter. The Levenol compounds have a ready biodegradability higher than 60% which is the minimum required value according to OECD 301B measurement to be acceptably biodegradable. Polyesterified nonionic compounds also useful in the instant compositions are Crovol PK-40 and Crovol PK-70 manufactured by Croda GMBH of the Netherlands. Crovol PK-40 is a polyoxyethylene (12) Palm Kernel Glyceride which has 12 EO groups. Crovol PK-70 which is preferred is a polyoxyethylene (45) Palm Kernel Glyceride have 45 EO groups. More information on these nonionic surfactants can be found in U.S. Pat. No. 5,719,114.

Another type of suitable nonionic surfactant comprises the polyhydroxy fatty acid amides. These materials are more fully described in Pan/Gosselink; U.S. Pat. No. 5,332,528; Issued Jul. 26, 1994, which is incorporated herein by reference. These polyhydroxy fatty acid amides have a general structure of the formula:

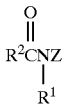

wherein: R1 is H, C1–C4 hydrocarbyl, 2-hydroxy ethyl, 2-hydroxy propyl, or a mixture thereof, preferably C1–C4 alkyl, more preferably C1 or C2 alkyl, most preferably C1 alkyl (i.e., methyl); and R2 is a C5–C31 hydrocarbyl, preferably straight chain C7–C19 alkyl or alkenyl, more preferably straight chain C9–C17 alkyl or alkenyl, most preferably straight chain C11–C15 alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —CH2-(CHOH)n-CH2OH, —CH(CH2OH)—(CHOH)n-1-CH2OH, —CH2-(CHOH)2(CHOR')(CHOH)—CH2OH, and alkoxylated derivatives thereof, where n is an integer from 3 to 5, inclusive, and R' is H or a cyclic or aliphatic monosaccharide. Most preferred are glycityls wherein n is 4, particularly —CH2-(CHOH)4-CH2OH.

R' can be, for example, N-methyl, N-ethyl, N-propyl, N-isopropyl, N-butyl, N-2-hydroxy ethyl or N-2-hydroxy propyl.

R2-CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

Examples of such surfactants include the C10–C18 N-methyl, or N-hydroxypropyl, glucamides. The N-propyl through N-hexyl C12–C16 glucamides can be used for lower sudsing performance.

Preferred amides are C8–C20 ammonia amides, monoethanolamides, diethanolamides, and isopropanolamides.

Another suitable class of surfactants are the alkanol amide surfactants, including the ammonia, monoethanol, and diethanol amides of fatty acids having an acyl moiety containing from about 8 to about 18 carbon atoms. These materials are represented by the formula:

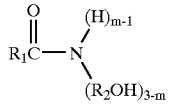

wherein R1 is a saturated or unsaturated, hydroxy-free aliphatic hydrocarbon group having from about 7 to 21, preferably from about 11 to 17 carbon atoms; R2 represents a methylene or ethylene group; and m is 1, 2, or 3, preferably 1. Specific examples of such amides are monoethanol amine coconut fatty acid amide and diethanolamine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanolamides and diethanolamides of C12–14 fatty acids are preferred.

Amphoteric Surfactants—Amphoteric surfactants may optionally be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 for examples of ampholytic surfactants. Preferred amphoteric include C12–C18 betaines and sulfobetaines ("sultaines"), C10–C18 amine oxides, and mixtures thereof When present, amphoteric surfactant will be present typically in an effective amount. More preferably, the composition may contain at least about 0.1%, more preferably at least about 0.2%, even more preferably still, at least about 0.5% by weight of said composition of amphoteric surfactant The composition will also preferably contain no more than about 20%, more preferably no more than about 15%, even more preferably, no more than about 10% by weight of said composition of amphoteric surfactant.

Amine oxides are amphoteric surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Preferred amine oxide surfactants have the formula

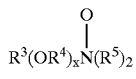

wherein R3 is an alkyl, hydroxyalkyl, or alkyl phenyl group or mixtures thereof containing from about 8 to about 22 carbon atoms; R4 is an alkylene or hydroxyalkylene group containing from about 2 to about 3 carbon atoms or mixtures thereof; x is from 0 to about 3; and each R5 is an alkyl or hydroxyalkyl group containing from about 1 to about 3 carbon atoms or a polyethylene oxide group containing from about 1 to about 3 ethylene oxide groups. The R5 groups can be attached to each other, e.g., through an oxygen or nitrogen atom, to form a ring structure.

These amine oxide surfactants in particular include $C_{10}$–C18 alkyl dimethyl amine oxides and C8–C12 alkoxy ethyl dihydroxy ethyl amine oxides.

When present, amine oxide surfactant will be present typically in an effective amount. More preferably, the composition may contain at least about 0.1%, more preferably at least about 0.2%, even more preferably still, at least about 0.5% by weight of said composition of amine oxide surfactant. The composition will also preferably contain no more than about 20%, more preferably no more than about 15%, even more preferably, no more than about 10% by weight of said composition of amine oxide surfactant.

Examples of suitable amine oxide surfactants are given in "Surface Active Agents and Detergents" (Vol. I and II by Schwartz, Perry and Berch).

Suitable betaine surfactants include those of the general formula:

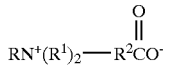

wherein R is a hydrophobic group selected from alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amino or ether linkages; each R1 is an alkyl group containing from 1 to about 3 carbon atoms; and R2 is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate. Other suitable amidoalkylbetaines are disclosed in U.S. Pat. Nos. 3,950,417; 4,137,191; and 4,375,421; and British Patent GB No. 2,103,236, all of which are incorporated herein by reference.

Zwitterionic Surfactants—Zwitterionic surfactants can also be incorporated into the detergent compositions hereof These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 for examples of zwitterionic surfactants. Ampholytic and zwitterionic surfactants are generally used in combination with one or more anionic and/or nonionic surfactants.

Detersive Enzymes—Enzymes are preferably included in the present detergent compositions for a variety of purposes, including removal of protein-based, carbohydrate-based, or triglyceride-based stains from substrates. Recent enzyme disclosures in detergents useful herein include chondriotinase (EP 747,469 A); protease variants (WO 96/28566 A; WO 96/28557 A; WO 96/28556 A; WO 96/25489 A); xylanase (EP 709,452 A); keratinase (EP 747,470 A); lipase (GB 2,297,979 A; WO 96/16153 A; WO 96/12004 A; EP 698,659 A; WO 96/16154 A); cellulase (GB 2,294,269 A;

WO 96/27649 A; GB 2,303,147 A); thermitase (WO 96/28558 A). More generally, suitable enzymes include cellulases, hemicellulases, proteases, gluco-amylases, amylases, lipases, cutinases, pectinases, xylanases, keratinases, reductases, oxidases, phenoloxidases, lipoxygenases, ligninases, pullulanases, tannases, chondriotinases, thermitases, pentosanases, malanases, β-glucanases, arabinosidases or mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. A preferred combination is a detergent composition having a cocktail of conventional applicable enzymes like protease, amylase, lipase, cutinase and/or cellulose. Suitable enzymes are also described in U.S. Pat. Nos. 5,677,272, 5,679,630, 5,703,027, 5,703,034, 5,705,464, 5,707,950, 5,707,951, 5,710,115, 5,710,116, 5,710,118, 5,710,119 and 5,721,202.

The composition will preferably contain at least about 0.0001%, more preferably at least about 0.0005%, even more preferably still, at least about 0.001% by weight of the composition of enzyme. The cleaning composition will also preferably contain no more than about 5%, more preferably no more than about 2%, even more preferably, no more than about 1% by weight of the composition of enzyme.

"Detersive enzyme", as used herein, means any enzyme having a cleaning, stain removing or otherwise beneficial effect in cleaning compositions. Preferred detersive enzymes are hydrolases such as proteases, amylases and lipases. Highly preferred are amylases and/or proteases, including both current commercially available types and improved types.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. For certain detergents it may be desirable to increase the active enzyme content of the commercial preparation in order to minimize the total amount of non-catalytically active materials and thereby improve spotting/filming or other end-results. Higher active levels may also be desirable in highly concentrated detergent formulations.

Proteolytic Enzyme—The proteolytic enzyme can be of animal, vegetable or microorganism (preferred) origin. The proteases for use in the detergent compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase® (Copenhagen, Denmark), Gist-brocades' Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent 251,446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Other proteases are sold under the tradenames: Primase, Durazym, Opticlean and Optimase. Preferred proteolytic enzymes, then, are selected from the group consisting of Alcalase® (Novo Industri A/S), BPN', Protease A and Protease B (Genencor), and mixtures thereof. Protease B is most preferred.

Of particular interest for use herein are the proteases described in U.S. Pat. No. 5,470,733.

Also proteases described in our co-pending application U.S. Ser. No. 08/136,797 can be included in the detergent composition of the invention.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens subtilisin*, as described in WO 95/10615 published Apr. 20, 1995 by Genencor International (A. Baeck et al. entitled "Protease-Containing Cleaning Compositions" having U.S. Ser. No. 08/322,676, filed Oct. 13, 1994).

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Protease enzyme may be incorporated into the compositions in accordance with the invention at a level of from 0.0001% to 2% active enzyme by weight of the composition, The composition will preferably contain at least about 0.0001%, more preferably at least about 0.0002%, more preferably at least about 0.0005%, even more preferably still, at least about 0.001% of active enzyme by weight of the composition of protease enzyme. The composition will also preferably contain no more than about 2%, more preferably no more than about 0.5%, more preferably no more than about 0.1%, even more preferably, no more than about 0.05% of active enzyme by weight of the composition of protease enzyme.

Amylase—Amylases (α and/or β) can be included for removal of carbohydrate-based stains. Suitable amylases are Termamyl® (Novo Nordisk), Fungamyl® and BAN® (Novo Nordisk). The enzymes may be of any suitable origin, such as vegetable, animal, bacterial, fungal and yeast origin.

The composition will preferably contain at least about 0.0001%, more preferably at least about 0.0002%, more preferably at least about 0.0005%, even more preferably still, at least about 0.001% of active enzyme by weight of the composition of amylase enzyme. The composition will also preferably contain no more than about 2%, more preferably no more than about 0.5%, more preferably no more than about 0.1%, even more preferably, no more than about 0.05% of active enzyme by weight of the composition of amylase enzyme.

Amylase enzymes also include those described in WO95/26397 and in co-pending application by Novo Nordisk PCT/DK96/00056. Other specific amylase enzymes for use in the detergent compositions of the present invention therefore include:

(a) α-amylases characterized by having a specific activity at least 25% higher than the specific activity of Termamyl® at a temperature range of 25° C. to 55° C. and at a pH value in the range of 8 to 10, measured by the Phadebas® α-amylase activity assay. Such Phadebas® α-amylase activity assay is described at pages 9–10, WO95/26397.

(b) α-amylases according (a) comprising the amino sequence shown in the SEQ ID listings in the above cited reference, or an α-amylase being at least 80% homologous with the amino acid sequence shown in the SEQ ID listing.

(c) α-amylases according (a) obtained from an alkalophilic Bacillus species, comprising the following amino sequence in the N-terminal: His-His-Asn-Gly-Thr-Asn-Gly-Thr-Met-Met-Gln-Tyr-Phe-Glu-Trp-Tyr-Leu-Pro-Asn-Asp.

A polypeptide is considered to be X% homologous to the parent amylase if a comparison of the respective amino acid sequences, performed via algorithms, such as the one described by Lipmnan and Pearson in Science 227, 1985, p. 1435, reveals an identity of X%

(d) α-amylases according (a–c) wherein the α-amylase is obtainable from an alkalophilic Bacillus species; and in particular, from any of the strains NCIB 12289, NCIB 12512, NCIB 12513 and DSM 935.

In the context of the present invention, the term "obtainable from" is intended not only to indicate an amylase produced by a Bacillus strain but also an amylase encoded by a DNA sequence isolated from such a Bacillus strain and produced in an host organism transformed with said DNA sequence.

(e) α-amylase showing positive immunological cross-reactivity with antibodies raised against an α-amylase having an amino acid sequence corresponding respectively to those α-amylases in (a–d).

(f) Variants of the following parent α-amylases which (i) have one of the amino acid sequences shown in corresponding respectively to those α-amylases in (a–e), or (ii) displays at least 80% homology with one or more of said amino acid sequences, and/or displays immunological cross-reactivity with an antibody raised against an α-amylase having one of said amino acid sequences, and/or is encoded by a DNA sequence which hybridizes with the same probe as a DNA sequence encoding an α-amylase having one of said amino acid sequence; in which variants:

1. at least one amino acid residue of said parent α-amylase has been deleted; and/or
2. at least one amino acid residue of said parent -amylase has been replaced by a different amino acid residue; and/or
3. at least one amino acid residue has been inserted relative to said parent α-amylase;

said variant having an α-amylase activity and exhibiting at least one of the following properties relative to said parent α-amylase: increased thermostability, increased stability towards oxidation, reduced Ca ion dependency, increased stability and/or α-amylolytic activity at neutral to relatively high pH values, increased α-amylolytic activity at relatively high temperature and increase or decrease of the isoelectric point (pI) so as to better match the pI value for α-amylase variant to the pH of the medium.

Said variants are described in the patent application PCT/DK96/00056.

Other amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis*, or *B. stearothermophilus*; (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from Humicola insolens or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® and CELLUZYME® (Novo) are especially useful. See also WO 9117243 to Novo.

The composition will preferably contain at least about 0.0001%, more preferably at least about 0.0002%, more preferably at least about 0.0005%, even more preferably still, at least about 0.001% of active enzyme by weight of the composition of cellulases and/or peroxidases enzyme. The composition will also preferably contain no more than about 2%, more preferably no more than about 0.5%, more preferably no more than about 0.1%, even more preferably, no more than about 0.05% of active enzyme by weight of the composition of cellulases and/or peroxidases enzyme.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor).

Lipase—Suitable lipase enzymes include those produced by microorganisms of the Pseudomonas group, such as Pseudomonas stutzeri ATCC 19.154, as disclosed in British Patent 1,372,034. Suitable lipases include those which show a positive immunological cross-reaction with the antibody of the lipase, produced by the microorganism Pseudomonas fluorescens IAM 1057. This lipase is available from Amano Pharmaceutical Co. Ltd., Nagoya, Japan, under the trade name Lipase P "Amano," hereinafier referred to as "Amano-P". Further suitable lipases are lipases such as M1 Lipase® and Lipomax® (Gist-Brocades). Other suitable commercial lipases include Amano-CES, lipases ex *Chromobacter viscosum*, e.g. *Chromobacter viscosum* var. lipolyticum NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Highly preferred lipases are the D96L lipolytic enzyme variant of the native lipase derived from *Humicola lanuginosa* as described in U.S. Ser. No. 08/341,826. (See also patent application WO 92/05249 viz. wherein the native lipase ex *Humicola lanuginosa* aspartic acid (D) residue at position 96 is changed to Leucine (L). According to this nomenclature said substitution of aspartic acid to Leucine in position 96 is shown as D96L.) Preferably the *Humicola lanuginosa* strain DSM 4106 is used.

In spite of the large number of publications on lipase enzymes, only the lipase derived from *Humicola lanuginosa* and produced in Aspergillus oryzae as host has so far found widespread application as additive for washing products. It is available from Novo Nordisk under the tradename Lipolase® and Lipolase Ultra®, as noted above. In order to optimize the stain removal performance of Lipolase, Novo Nordisk have made a number of variants. As described in WO 92/05249, the D96L variant of the native *Humicola lanuginosa* lipase improves the lard stain removal efficiency by a factor 4.4 over the wild-type lipase (enzymes compared in an amount ranging from 0.075 to 2.5 mg protein per liter). Research Disclosure No. 35944 published on Mar. 10, 1994, by Novo Nordisk discloses that the lipase variant (D96L) may be added in an amount corresponding to 0.001–100-mg (5–500,000 LU/liter) lipase variant per liter of wash liquor.

The composition will preferably contain at least about 0.0001%, more preferably at least about 0.0002%, more preferably at least about 0.0005%, even more preferably still, at least about 0.001% of active enzyme by weight of the composition of lipase enzyme. The composition will also preferably contain no more than about 2%, more preferably no more than about 0.5%, more preferably no more than about 0.1%, even more preferably, no more than about 0.05% of active enzyme by weight of the composition of lipase enzyme.

Various carbohydrase enzymes which impart antimicrobial activity may also be included in the present invention. Such enzymes include endoglycosidase, Type II endoglycosidase and glucosidase as disclosed in U.S. Pat. Nos. 5,041,236, 5,395,541, 5,238,843 and 5,356,803 the disclosures of which are herein incorporated by reference. Of course, other enzymes having antimicrobial activity may be employed as well including peroxidases, oxidases and various other enzymes.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilized by various techniques. Enzyme stabilization techniques are disclosed and exemplified in U.S. Pat. No. 3,600,319, Aug. 17, 1971, Gedge et al, EP 199,405 and EP 200,586, Oct. 29, 1986, Venegas. Enzyme stabilization systems are also described, for example, in U.S. Pat. No. 3,519,570. A useful Bacillus, sp. AC13 giving proteases, xylanases and cellulases, is described in WO 9401532 A to Novo.

It is also possible to include an enzyme stabilization system into the compositions of the present invention when any enzyme is present in the composition.

Enzyme Stabilizing System—The preferred compositions herein may additionally comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the protease or other enzymes used in the compositions herein. Such stabilizing systems can comprise calcium ion, boric acid, propylene glycol, short chain carboxylic acid, boronic acid, polyhydroxyl compounds and mixtures thereof such as are described in U.S. Pat. No. 4,261,868, Hora et al, issued Apr. 14, 1981; U.S. Pat. No. 4,404,115, Tai, issued Sep. 13, 1983; U.S. Pat. No. 4,318,818, Letton et al; U.S. Pat. No. 4,243,543, Guildert et al issued Jan. 6, 1981; U.S. Pat. No. 4,462,922, Boskamp, issued Jul. 31, 1984; U.S. Pat. No. 4,532,064, Boskamp, issued Jul. 30, 1985; and U.S. Pat. No. 4,537,707, Severson Jr., issued Aug. 27, 1985, all of which are incorporated herein by reference.

The composition will preferably contain at least about 0.001%, more preferably at least about 0.005%, even more preferably still, at least about 0.01% by weight of the composition of enzyme stabilizing system. The composition will also preferably contain no more than about 10%, more preferably no more than about 8%, no more than about 6% of active enzyme by weight of the composition of enzyme stabilizing system.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical detergent compositions, especially liquids, will comprise from about 1 to about 30, preferably from about 2 to about 20, more preferably from about 8 to about 12 millimoles of calcium ion per liter of finished detergent composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of Calcium and/or Magnesium may of course be useful for example for promoting the grease-cutting action of certain types of surfactant However, it is especially preferred that the composition contain no added calcium ions, and even more preferred that the composition be free of calcium ions.

Another stabilizing approach is by use of borate species. See Severson, U.S. Pat. No. 4,537,706. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butane-boronic acid, p-bromophenylboronic acid or the like can be used in place of boric acid and reduced levels of total boron in detergent compositions may be possible though the use of such substituted boron derivatives.

Additionally, from 0% to about 10%, preferably from about 0.01% to about 6% by weight, of chlorine bleach or oxygen bleach scavengers can be added to compositions of the present invention to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbonate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodium perborate monohydrate, percarbonate, phosphate, condensed phosphate, acetate, benzoate, citrate, formate, lactate, malate, tartrate, salicylate, etc. and mixtures thereof can also be used.

Builders—Detergent builders are optionally included in the compositions herein. In solid formulations, builders sometimes serve as absorbents for surfactants. Altenately, certain compositions can be formulated with completely water-soluble builders, whether organic or inorganic, depending on the intended use.

Suitable silicate builders include water-soluble and hydrous solid types and including those having chain-, layer-, or three-dimensional-structure as well as amorphous-solid silicates or other types, for example especially adapted for use in non-structured-liquid detergents. Preferred are alkali metal silicates, particularly those liquids and solids having a $SiO_2$:$Na_2O$ ratio in the range 1.6:1 to 3.2:1, including solid hydrous 2-ratio silicates marketed by PQ Corp. under the tradename BRITESIL®, e.g., BRITESIL H2O; and layered silicates, e.g., those described in U.S. Pat. No. 4,664,839, May 12, 1987, H. P. Rieck. NaSKS-6, sometimes abbreviated "SKS-6", is a crystalline layered aluminum-free $\delta$-$Na_2SiO_5$ morphology silicate marketed by Hoechst and is preferred especially in granular compositions. See preparative methods in German DE-A-3,417,649 and DE-A-3,742,043. Other layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0, can also or alternately be used herein. Layered silicates from Hoechst also include NaSKS-5, NaSKS-7 and NaSKS-11, as the $\alpha$, $\beta$ and $\gamma$ layer-silicate forms. Other silicates may also be useful, such as magnesium silicate, which can serve as a crispening agent in granules, and as a component of suds control systems.

Also suitable for use herein are synthesized crystalline ion exchange materials or hydrates thereof having chain structure and a composition represented by the following general formula in an anhydride form: $xM_2O.ySiO_2.zM'O$ wherein M is Na and/or K, M' is Ca and/or Mg; y/x is 0.5 to 2.0 and z/x is 0.005 to 1.0 as taught in U.S. Pat. No. 5,427,711, Sakaguchi et al, Jun. 27, 1995.

Aluminosilicate builders, such as zeolites, are especially useful in granular detergents, but can also be incorporated in liquids, pastes or gels. Suitable for the present purposes are those having empirical formula: $[M_z(AlO_2)_z(SiO_2)_v].xH_2O$ wherein z and v are integers of at least 6, M is an alkali metal, preferably Na and/or K, the molar ratio of z to v is in the range from 1.0 to 0.5, and x is an integer from 15 to 264. Aluminosilicates can be crystalline or amorphous, naturally-occurring or synthetically derived. An aluminosilicate production method is in U.S. Pat. No. 3,985,669, Krummel, et al, Oct. 12, 1976. Preferred synthetic crystalline aluminosilicate ion exchange materials are available as Zeolite A, Zeolite P (B), Zeolite X and, to whatever extent this differs from Zeolite P, the so-called Zeolite MAP. Natural types, including clinoptilolite, may be used Zeolite A has the formula: $Na_{12}[(AlO_2)_{12}(SiO_2)_{12}].xH_2O$ wherein x is from 20 to 30, especially 27. Dehydrated zeolites (x=0–10) may also be used. Preferably, the aluninosilicate has a particle size of 0.1–10 microns in diameter.

Detergent builders in place of or in addition to the silicates and aluminosilicates described hereinbefore can optionally be included in the compositions herein, for example to assist in controlling mineral, especially Ca and/or Mg, hardness in wash water or to assist in the removal of particulate soils from surfaces. Builders can operate via a variety of mechanisms including forming soluble or insoluble complexes with hardness ions, by ion exchange, and by offering a surface more favorable to the precipitation of hardness ions than are the surfaces of articles to be cleaned. Builder level can vary widely depending upon end use and physical form of the composition. Built detergents typically comprise at least about 1% builder. Liquid formulations typically comprise about 5% to about 50%, more typically 5% to 35% of builder. Granular formulations typically comprise from about 10% to about 80%, more typically 15% to 50% builder by weight of the detergent composition. Lower or higher levels of builders are not excluded. For example, certain formulations can be unbuilt, that is the compositions contain no builder such as in some hand dishwashing compositions.

Suitable builders herein can be selected from the group consisting of phosphates and polyphosphates, especially the sodium salts; carbonates, bicarbonates, sesquicarbonates and carbonate minerals other than sodium carbonate or sesquicarbonate; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and phytic acid These may be complemented by borates, e.g., for pH-buffering purposes, or by sulfates, especially sodium sulfate and any other fillers or carriers which may be important to the engineering of stable surfactant and/or builder-containing detergent compositions.

Builder mixtures, sometimes termed "builder systems" can be used and typically comprise two or more conventional builders, optionally complemented by chelants, pH-buffers or fillers, though these latter materials are generally accounted for separately when describing quantities of materials herein. In terms of relative quantities of surfactant and builder in the present detergents, preferred builder systems are typically formulated at a weight ratio of surfactant to builder of from about 60:1 to about 1:80. Certain preferred laundry detergents have said ratio in the range 0.90:1.0 to 4.0:1.0, more preferably from 0.95:1.0 to 3.0:1.0.

P-containing detergent builders often preferred where permitted by legislation include, but are not limited to, the alkali metal, ammonium and alkanolammonium salts of polyphosphates exemplified by the tripolyphosphates, pyrophosphates, glassy polymeric meta-phosphates; and phosphonates.

Suitable carbonate builders include alkaline earth and alkali metal carbonates as disclosed in German Patent Application No. 2,321,001 published on Nov. 15, 1973, although sodium bicarbonate, sodium carbonate, sodium sesquicarbonate, and other carbonate minerals such as trona or any convenient multiple salts of sodium carbonate and calcium carbonate such as those having the composition $2Na_2CO_3.CaCO_3$ when anhydrous, and even calcium carbonates including calcite, aragonite and vaterite, especially forms having high surface areas relative to compact calcite may be useful, for example as seeds.

Suitable "organic detergent builders", as described herein for use in the cleaning compositions include polycarboxylate compounds, including water-soluble nonsurfactant dicarboxylates and tricarboxylates. More typically builder polycarboxylates have a plurality of carboxylate groups, preferably at least 3 carboxylates. Carboxylate builders can be formulated in acid, partially neutral, neutral or overbased form. When in salt form, alkali metals, such as sodium, potassium, and lithium, or alkanolammonium salts are preferred. Polycarboxylate builders include the ether polycarboxylates, such as oxydisuccinate, see Berg, U.S. Pat. No. 3,128,287, Apr. 7, 1964, and Lamberti et al, U.S. Pat. No. 3,635,830, Jan. 18, 1972; "TMS/TDS" builders of U.S. Pat. No. 4,663,071, Bush et al, May 5, 1987; and other ether carboxylates including cyclic and alicyclic compounds, such as those described in U.S. Pat. Nos. 3,923,679; 3,835,163; 4,158,635; 4,120,874 and 4,102,903.

Other suitable organic detergent builders are the ether hydroxypolycarboxylates, copolymers of maleic anhydride with ethylene or vinyl methyl ether; 1, 3, 5-trihydroxy benzene-2,4,6-trisulphonic acid; carboxymethyloxysuccinic acid; the various alkali metal, ammonium and substituted ammonium salts of polyacetic acids such as ethylenediamine tetraacetic acid and nitrilotriacetic acid; as well as mellitic acid, succinic acid, polymaleic acid, benzene 1,3,5-tricarboxylic acid, carboxymethyloxysuccinic acid, and soluble salts thereof.

Citrates, e.g., citric acid and soluble salts thereof are important carboxylate builders e.g., for light duty liquid detergents, due to availability from renewable resources and biodegradability. Citrates can also be used in granular compositions, especially in combination with zeolite and/or layered silicates. Oxydisuccinates are also especially useful in such compositions and combinations.

Where permitted, and especially in the formulation of bars, alkali metal phosphates such as sodium tripolyphosphates, sodium pyrophosphate and sodium orthophosphate can be used. Phosphonate builders such as ethane-1-hydroxy-1,1-diphosphonate and other known phosphonates, e.g., those of U.S. Pat. Nos. 3,159,581; 3,213,030; 3,422,021; 3,400,148 and 3,422,137 can also be used and may have desirable antiscaling properties.

Certain detersive surfactants or their short-chain homologues also have a builder action. For unambiguous formula accounting purposes, when they have surfactant capability, these materials are summed up as detersive surfactants. Preferred types for builder functionality are illustrated by: 3,3-dicarboxy-4-oxa-1,6-hexanedioates and the related compounds disclosed in U.S. Pat. No. 4,566,984, Bush, Jan. 28, 1986. Succinic acid builders include the $C_5$–$C_{20}$ alkyl and alkenyl succinic acids and salts thereof. Succinate builders also include: laurylsuccinate, myristylsuccinate, palmitylsuccinate, 2-dodecenylsuccinate (preferred), 2-pentadecenylsuccinate, and the like. Lauryl-succinates are described in European Patent Application 86200690.5/0, 200,263, published Nov. 5, 1986. Fatty acids, e.g., $C_{12-18}$ monocarboxylic acids, can also be incorporated into the compositions as surfactant/builder materials alone or in combination with the aforementioned builders, especially citrate and/or the succinate builders, to provide additional builder activity. Other suitable polycarboxylates are disclosed in U.S. Pat. No. 4,144,226, Crutchfield et al, Mar. 13, 1979 and in U.S. Pat. No. 3,308,067, Diehl, Mar. 7, 1967. See also Diehl, U.S. Pat. No. 3,723,322.

Other types of inorganic builder materials which can be used have the formula $(M_x)_iCa_y(CO_3)_z$ wherein x and i are integers from 1 to 15, y is an integer from 1 to 10, z is an integer from 2 to 25, $M_i$ are cations, at least one of which is a water-soluble, and the equation $\Sigma_i=_{1-15}(x_i$ multiplied by the valence of $M_i)+2y=2z$ is satisfied such that the formula has a neutral or "balanced" charge. These builders are referred to herein as "Mineral Builders", examples of these builders, their use and preparation can be found in U.S. Pat. No. 5,707,959. Another suitable class of inorganic builders are the Magnesiosilicates, see WO97/0179.

Suitable polycarboxylates builders for use herein include maleic acid, citric acid, preferably in the form of a water-soluble salt, derivatives of succinic acid of the formula R—CH(COOH)CH2(COOH) wherein R is $C_{10-20}$ alkyl or alkenyl, preferably C12–16, or wherein R can be substituted with hydroxyl, sulfo sulfoxyl or sulfone substituents. Mixtures of these suitable polycarboxylates builders is also envisioned, such as a mixture of maleic acid and citric acid. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

The composition will preferably contain at least about 0.2%, more preferably at least about 0.5%, more preferably at least about 3%, even more preferably still, at least about 5% by weight of the composition of builder. The cleaning composition will also preferably contain no more than about 50%, more preferably no more than about 40% more preferably no more than about 30%, even more preferably, no more than about 25% by weight of the composition of builder.

Magnesium Ions—The presence of magnesium (divalent) ions improves the cleaning of greasy soils for various compositions, i.e., compositions containing alkyl ethoxy sulfates and/or polyhydroxy fatty acid amides. This is especially true when the compositions are used in softened water that contains few divalent ions. It is believed, while not wanting to be limited by theory, that, magnesium ions increase the packing of the surfactants at the oil/water interface, thereby reducing interfacial tension and improving grease cleaning. Compositions of the invention herein containing magnesium ions exhibit good grease removal, manifest mildness to the skin, and provide good storage stability.

The composition will preferably contain at least about 0.01%, more preferably at least about 0.015%, more preferably at least about 0.02%, even more preferably still, at least about 0.025% by weight of said composition of magnesium ions. The cleaning composition will also preferably contain no more than about 5%, more preferably no more than about 2.5%, more preferably no more than about 1%, even more preferably, no more than about 0.05% by weight of said composition of magnesium ions. In any event the amount of magnesium ions present will always be equimolar or less than the amount of diamine present in the composition.

Preferably, the magnesium ions are added as a hydroxide, chloride, acetate, formate, oxide or nitrate salt to the compositions of the present invention.

Formulating such divalent ion-containing compositions in alkaline pH matrices may be difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates. Therefore, chelating agents discussed hereinafter may also be necessary.

Diamines—It is preferred that the diamines used in the present invention are substantially free from impurities. That is, by "substantially free" it is meant that the diamines are over 95% pure, i.e., preferably 97%, more preferably 99%, still more preferably 99.5%, free of impurities. Examples of impurities which may be present in commercially supplied diamines include 2-Methyl-1,3-diaminobutane and alkylhydropyrimidine. Further, it is believed that the diamines should be free of oxidation reactants to avoid diamine degradation and ammonia formation. Additionally, if amine oxide and/or other surfactants are present, the amine oxide or surfactant should be hydrogen peroxide-free. The preferred level of hydrogen peroxide in the amine oxide or surfatant paste of amine oxide is 0–40 ppm, more preferably 0–15 ppm. Amine impurities in amine oxide and betaines, if present, should be minimized to the levels referred above for hydrogen peroxide.

Making the compositions free of hydrogen peroxide is important when the compositions contain an enzyme. The peroxide can react with the enzyme and destroy any performance benefits the enzyme adds to the composition. Even small amounts of hydrogen peroxide can cause problems with enzyme containing formulations. However, the diamine can react with any peroxide present and act as an enzyme stabilizer and prevent the hydrogen peroxide from reacting with the enzyme. The only draw back of this stabilization of the enzymes by the diamine is that the nitrogen compounds produced are believed to cause the malodors which can be present in diamine containing compositions. Having the diamine act as an enzyme stabilizer also prevents the diamine from providing the benefits to the composition for which it was originally put in to perform, namely, grease cleaning, sudsing, dissolution and low temperature stability. Therefore, it is preferred to minimize the amount of hydrogen peroxide present as an impurity in the inventive compositions either by using components which are substantially free of hydrogen peroxide and/or by using non-diamine antioxidants even though the diamine can act as an enzyme stabilizer, because of the possible generation of malodorous compounds and the reduction in the amount of diamine available present to perform its primary role.

It is further preferred that the compositions of the present invention be "malodor" free. That is, that the odor of the headspace does not generate a negative olfactory response from the consumer. This can be achieved in many ways, including the use of perfumes to mask any undesirable odors, the use of stabilizers, such as antioxidants, chelants etc., and/or the use of diamines which are substantially free of impurities. It is believed, without wanting to being limited by theory, that it is the impurities present in the diamines that are the cause of most of the malodors in the compositions of the present invention. These impurities can form during the preparation and storage of the diamines. They can also form during the preparation and storage of the inventive composition. The use of stabilizers such as antioxidants and chelants inhibit and/or prevent the formation of these impurities in the composition from the time of preparation to ultimate use by the consumer and beyond. Hence, it is most preferred to remove, suppress and/or prevent the formation of these malodors by the addition of perfumes, stabilizers and/or the use of diamines which are substantially free from impurities.

One type of preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3-bis (methylamine)-cyclohexane, 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by Dupont, a supplier of diamines.

As a working definition herein, the pKa of the diamines is specified in an aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, NY, 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

Some of the diamines useful herein can be defined by the following structure:

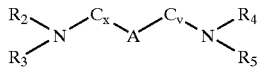

wherein R2–5 are independently selected from H. methyl, —CH3CH2, and ethylene oxides; Cx and Cv are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater.

Alternatively the diamines can be those organic diamines with a molecular weight less than or equal to 400 g/mol. It is preferred that these diamines have the formula:

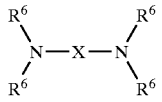

wherein each R6 is independently selected from the group consisting of hydrogen, C1–C4 linear or branched alkyl, alkyleneoxy having the formula:

$$-(R^7O)_mR^8$$

wherein R7 is C2–C4 linear or branched alkylene, and mixtures thereof; $R_8$ is hydrogen, $C_1$–C4 alkyl and mixtures thereof; m is from 1 to about 10; X is a unit selected from:

i) C3–C10 linear alkylene, C3–C10 branched alkylene, C3–C10 cyclic alkylene, C3–C10 branched cyclic alkylene, an alkyleneoxyalkylene having the formula:

$$-(R^7O)_mR^7-$$

wherein R7 and m are the same as defined herein above;

ii) C3–C10 linear, C3–C10branched linear, C3–C10 cyclic, C3–C10 branched cyclic alkylene, C6C1 arylene, wherein said unit comprises one or more electron donating or electron withdrawing moieties which provide said diamine with a pKa greater than about 8; and iii) mixtures of (i) and (ii)

provided said diamine has a pKa of at least about 8.

Examples of preferred diamines include the following: dimethyl aminopropyl amine, 1,6-hexane diamine, 1,3 propane diamine, 2-methyl 1,5 pentane diamine, 1,3-Pentanediamine (available under the tradename Dytek EP), 1,3-diaminobutane, 1,2-bis(2-aminoethoxy)ethane, (available under the tradename Jeffamine EDR 148), Isophorone diamine, 1,3-bis(methylamine)cyclohexane, and mixtures thereof.

Polymeric Suds Stabilizer—The compositions of the present invention may optionally contain a polymeric suds stabilizer. These polymeric suds stabilizers provide extended suds volume and suds duration without sacrificing the grease cutting ability of the liquid detergent compositions. These polymeric suds stabilizers are preferably selected from:

i) homopolymers of (N,N-dialkylamino)alkyl acrylate esters having the formula:

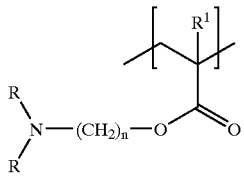

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

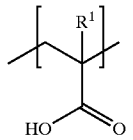

wherein $R^1$ is hydrogen, C1–C6 alkyl, and mixtures thereof provided that the ratio of (ii) to (i) is from about 2 to 1 to about 1 to 2; The molecular weight of the polymeric suds boosters, determined via conventional gel permeation chromatography, is from about 1,000 to about 2,000,000, preferably from about 5,000 to about 1,000,000, more preferably from about 10,000 to about 750,000, more preferably from about 20,000 to about 500,000, even more preferably from about 35,000 to about 200,000. The polymeric suds stabilizer can optionally be present in the form of 8 salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely

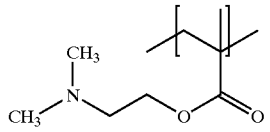

The composition will preferably contain at least about 0.01%, more preferably at least about 0.05%, even more preferably still, at least about 0.1% by weight of the composition of polymeric suds booster. The cleaning composition will also preferably contain no more than about 15%, more preferably no more than about 10%, even more preferably, no more than about 5% by weight of the composition of polymeric suds booster.

Other suitable polymeric suds stabilizers, including protenacious suds stabilizers and zwitterionic suds stabilizers, can be found in WO 99/27058, WO 99/27054, WO 99/2703, and WO 99/27057.

Another suitable type of suds stabilizers are the cationic copolymer stabilizers, which contain approximately by weight, more than 50% of units derived from acrylamide, methacrylamide or a mixture thereof, 0.5 to 2% of pendant quaternary nitrogen, and 0.1 to 10% of pendant C.sub.8–24 hydrophobic groups, preferably the copolymer contains, approximately by weight, 55 to 95% of units derived from acrylamide, methacrylamide or a mixture thereof, 4 to 30% of hydrophilically functional units having the molecular configuration of units derived from at least one monoethylenically unsaturated quaternary ammonium group-containing monomer, and 1 to 15% of units derived from at least one monoethylenically unsaturated, C.sub.8–24 hydrophobic group containing monomer devoid of quaternary nitrogen. It is more preferred that the quaternary ammonium group-containing monomer has the formula

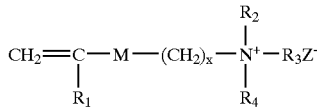

wherein $R_1$ is H or $CH_3$, $R_2$ and $R_3$ are independently $C_{1-4}$ alkyls, $R_4$ is $C_{1-4}$ alkyl, $C_{2-3}$ hydroxyalkyl, or benzyl $R_2$, $R_3$ and $R_4$ together contain less than 9 carbon atoms, Z is a water-solubilizing salt-forming anion, and M may be —CO—X—, then X is —O— or —$NR_5$—, $R_5$ is H or $C_{1-4}$ alkyl and x is 1–6, or M may be phenylene then x is 1; and, that the hydrophobic group-containing monomer has the formula

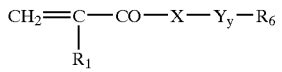

wherein $R_1$ is H or $CH_3$, X is —O— or —$NR_7$—, Y is —$C_2H_4O$— or —$C_3H_7O$—, y is 0–60, when X is —O—, $R_6$ is $C_{8-24}$ hydrocarbyl, and when X is —$NR_7$—, $R_6$ is $C_{1-24}$ hydrocarbyl and $R_7$ is H or $C_{1-24}$ hydrocarbyl, at least one of $R_6$ and $R_7$ being $C_{8-24}$ hydrocarbyl. For more details on these cationic copolymer stabilizers see U.S. Pat. No. 4,454,060.

Thickener—The dishwashing detergent compositions herein can also contain from about 0.2% to 5% of a thickening agent. More preferably, such a thickener will comprise from about 0.5% to 2.5% of the compositions herein. Thickeners are typically selected from the class of cellulose derivatives. Suitable thickeners include hydroxy ethyl cellulose, hydroxyethyl methyl cellulose, carboxy methyl cellulose, Quatrisoft LM200, and the like. A preferred thickening agent is hydroxypropyl methylcellulose.

The composition may preferably contain at least about 0.1%, more preferably at least about 0.2%, even more preferably still, at least about 5% by weight of the composition of thickener. The composition will also preferably contain no more than about 5%, more preferably no more than about 3%, even more preferably, no more than about 2.5% by weight of the composition of thickener.

The hydroxypropyl methylcellulose polymer has a number average molecular weight of about 50,000 to 125,000 and a viscosity of a 2 wt. % aqueous solution at 25° C. (ADTMD2363) of about 50,000 to about 100,000 cps. An especially preferred hydroxypropyl cellulose polymer is Methocel® J75MS-N wherein a 2.0 wt. % aqueous solution at 25° C. has a viscosity of about 75,000 cps. Especially preferred hydroxypropyl cellulose polymers are surface treated such that the hydroxypropyl cellulose polymer will ready disperse at 25° C. into an aqueous solution having a pH of at least about 8.5.

When formulated into the dishwashing detergent compositions of the present invention, the hydroxypropyl methylcellulose polymer should impart to the detergent composition a Brookfield viscosity of from about 500 to 3500 cps at 25° C. More preferably, the hydroxypropyl methylcellulose material will impart a viscosity of from about 1000 to 3000 cps at 25° C. For purposes of this invention, viscosity is measured with a Brookfield LVTDV-11 viscometer apparatus using an RV #2 spindle at 12 rpm.

Also suitable for use as thickeners are the clay thickeners. One suitable clay thickener is Laponite. The Laponite clay when used, is present in the instant composition at a concentration of about 0.25% to about 2.0 wt. %, more preferably about 0.5 to about 1.75 wt. % is a synthetic colored clay optionally having at least about 5.0 wt. % of tetrapotassium pyrrophosphate peptizer which is Laponite RDS. The particle size of Laponite RDS which is manufactured by Laponite Inorganics of Great Britain has a particle size of <2% greater than 250 microns a bulk density of about 1000 Kg/m.sup.3, and a surface area of about 330 m.sup.3/g. Laponite RD does not have a peptizer and has a particle size of <2% greater than 250 microns, a surface area of about 370 m.sup.2/g and a bulk density of about 1000 Kg/m.sup.3.

When the compositions contain an abrasive the dishwashing composition may also contain a colloid-foaming, expandable clay which unctions both as a thickening agent for the formula and as a suspending agent for the abrasive. These expandable clays are those classified geologically as smectites and attapulgites. Suitable smectite clays are the montmorillonite clays which are primarily hydrated aluminosilicates and the hectorites which are primarily hydrated magnesium silicates. It should be understood that the proportion of water of hydration in the smectite clays varies with the manner in which the clay has been processed. However, the amount of water present is not significant because the expandable characteristics of the hydrated smectite clays are dictated by the silicate lattice structure. Additionally, deficit charges in smectite are compensated by cations such as sodium, calcium, potassium, etc., which are sorbed between the three layer (two tetrahedral and one octahedral) clay mineral sandwiches. The smectite clays used in the liquid compositions are commercially available under various trade names such as Thixogel No. 1 and Gelwhite GP from Georgia Kaolin Company (both montmorillonites) and Veegum Pro and Veegum F from R. T. Vanderbilt (both hectorites). A preferred clay is Gelwhite GP which is a colloidal montmorillonite clay of a high viscosity sold by Georgia Kaolin company. This clay contains about 6% to 10% by weight of water and is a mixture of the following oxides: 59% SIO.sub.2, 21% Al.sub.3 O.sub.3, 1% Fe.sub.2 O.sub.3, 2.4% CaO, 3.8% MgO, 4.1% Na.sub.2 O and 0.4% K.sub.2 O. 100% by weight of the clay passes through a 200 mesh screen. It disperses readily in water, but requires maximum swelling in water before use. This swelling of the clay is important to eliminate liquid layering. During this swelling process, the clay/water mix builds substantial viscosity. It is also thixotropic and, therefore, exhibits a yield point as well. 350 dynes/cm.sub.2 has been judged to be a preferred yield point for a clay/water mix of Gelwhite GP because at this point the other physical properties of the final composition, e.g., pourability, dispersibility, suspending ability and liquid layering, are acceptable. (The term "layering" refers to the amount—in millimeters—of clear liquid visible on the surface of the finished formula after aging at 49.degree. C. for one week and for ten weeks.) A clay/water mix having a yield point of 350 dynes/cm.sup.2 is acceptable regardless of Gelwhite GP concentration. The yield point normally is measured using HAAKE rv12, MVIP, E=0.3, R=100 O=113 min, 18 minute hold, grooved rotor and cup. Another expandable clay material suitable for use in the liquid compositions is classified geologically as attapulgite, a magnesium rich clay. A typical attapulgite analysis yields 55.02% SiO.sub.2 ; 10.24% Al.sub.2 O.sub.3 ; 3.53% Fe.sub.2 O.sub.3 ; 10.49% MgO; 0.47% K.sub.2 O; 9.73% H.sub.2 O removed at 150.degree. C. and 10.13% H.sub.2 O removed at higher temperatures. These clays have a small particle size, with 100% of the clay passing through a 200 mesh screen. Attapulgite clays are commercially available under various trade names such as Attagel 40, Attagel 50 and Attagel 150 from Engelhard Minerals & Chemicals Corporation. Of course, mixtures of smectite clays and attapulgite clays are suitable, too, to provide combinative properties which are not obtained from either class of clay above. In order to achieve the desired swelling, a suspension of clay in water is subjected to high-shear mixing for a sufficient time to substantially fully hydrate the clay before its introduction into the organic portion of the formulation. For example, the desired swelling can be accomplished by high speed shearing of an 8% aqueous clay dispersion for 25 minutes. When the clay is substantially fully hydrated, the viscosity of the aqueous suspension increases dramatically and, thus, the swelling process permits the use of lower concentrations of clay. For example, concentrations of clay as low as 1% to 1.55% and up to a maximum of 3%, preferably 1.2% to 2%, by weight are effective to stabilize the inventive abrasive composition without adversely affecting its dispersibility in water. As indicated above, the clay/water mix used in the described composition preferably has a yield point of about 350 dynes/cm$^2$, but satisfactory abrasive compositions can be prepared with aqueousclay dispersions having a yield point as low as 300 dynes/cm$^2$and as high as 450 dynes/cm$^2$. The foregoing water-insoluble, low-density, abrasives are suspended in the dishwashing liquid composition and their concentration ranges from 3% to 15%, preferably from 5% to 15%, by weight. If desired, small amounts, e.g., 1% to 25% by weight (based upon the total weight of abrasive in the composition), of crystalline abrasives having a Mohs hardness of 2 to 7 such as silica or calcium carbonate may be substituted for part of the low density abrasive provided that a substantially stable liquid dishwashing composition results.

Abrasive—The instant cleaning compositions may optionally contain from about 0 to about 20 wt. %, more preferably about 0.5 to about 10 wt. % of an abrasive. The abrasive is preferably of selected from the group consisting of amorphous hydrated silica, calcite which is a limestone calcium carbonate, and polyethylene powder particles and mixtures thereof A suitable amorphous silica (oral grade) to enhance the scouring ability of the composition is provided by Zeoffin. The mean particle size of Zeoffin silica is 8 up to 10 mm. Its apparent density is 0.32 to 0.37 g/ml. Another silica is Tixosil 103 made by Rhone-Poulenc. An amorphous hydrated silica from Crosfield of different particles sizes (9, 15 and 300 mm), and same apparent density was also used. One polyethylene powder suitable for use in the instant invention has a particle size of about 200 to about 500 microns and a density of about 0.91 to about 0.99 g/liter, more preferably about 0.94 to about 0.96. Another preferred abrasive is calcite used at a concentration of about 0% to 20 wt. %, more preferably 1 wt. % to 10 wt. % and is manufactured by J. M. Huber Corporation of Illinois. Calcite is a limestone consisting primarily of calcium carbonate and 1% to 50% of magnesium carbonate which has a mean particle size of 5 microns and oil absorption (rubout) of about 10 and a hardness of about 3.0 Mohs.

Solvents—A variety of water-miscible liquids such as lower alkanols, diols, other polyols, ethers, amines, and the like may be used Particularly preferred are the $C_1$–$C_4$ alkanols. Such solvents can be present in the compositions herein to the extent of from about 1% to 8%.

When present the composition will preferably contain at least about 0.01%, more preferably at least about 0.5%, even more preferably still, at least about 1% by weight of the composition of solvent The composition will also preferably contain no more than about 20%, more preferably no more than about 10%, even more preferably, no more than about 8% by weight of the composition of solvent.

These solvents may be used in conjunction with an aqueous liquid carrier, such as water, or they may be used without any aqueous liquid carrier being present. Solvents an are broadly defined as compounds that are liquid at temperatures of 20° C.–25° C. and which are not considered to be surfactants. One of the distinguishing features is that solvents tend to exist as discrete entities rather than as broad mixtures of compounds. Examples of suitable solvents for the present invention include, methanol, ethanol, propanol, isopropanol, 2-methyl pyrrolidinone, benzyl alcohol and morpholine n-oxide. Preferred among these solvents are methanol and isopropanol.

Suitable solvents for use herein include ethers and diethers having from 4 to 14 carbon atoms, preferably from 6 to 12 carbon atoms, and more preferably from 8 to 10 carbon atoms. Also other suitable solvents are glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable glycols which can be used herein are according to the formula HO—CR1R2-OH wherein R1 and R2 are independently H or a C2–C10 saturated or unsaturated aliphatic hydrocarbon chain and/or cyclic. Suitable glycols to be used herein are dodecaneglycol and/or propanediol. Also suitable are polypropylene glycols, such as those with a molecular weigh in the range of about 100 to 1000. One suitable polypropylene glycol ha a molecular weight of about 2700.

Suitable alkoxylated glycols which can be used herein are according to the formula R—(A)n-R1-OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols which can be used herein are according to the formula R $(A)_n$—OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols which can be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols which can be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula R $(A)_n$—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable alkoxylated linear C1–C5 alcohols which can be used herein are according to the formula R $(A)_n$—OH wherein R is a linear saturated or unsaturated alkyl group of from 1 to 5 carbon atoms, preferably from 2 to 4, wherein A is an alkoxy group preferably butoxy, propoxy and/or ethoxy, and n is an integer of from 1 to 5, preferably 1 to 2. Suitable alkoxylated aliphatic linear C1–C5 alcohols are butoxy propoxy propanol (n-BPP), butoxyethanol, butoxypropanol, ethoxyethanol or mixtures thereof Butoxy propoxy propanol is commercially available under the trade name n-BPP® from Dow chemical.

Suitable linear C1–C5 alcohols which can be used herein are according to the formula R—OH wherein R is a linear saturated or unsaturated alkyl group of from 1 to 5 carbon atoms, preferably from 2 to 4. Suitable linear C1–C5 alcohols are methanol, ethanol, propanol or mixtures thereof.

Other suitable solvents include, but are not limited to, butyl diglycol ether (BDGE), butyltriglycol ether, ter amilic alcohol and the like. Particularly preferred be solvents which can be used herein are butoxy propoxy propanol butyl diglycol ether, benzyl alcohol, butoxypropanol, ethanol, methanol, isopropanol and mixtures thereof.

Other suitable solvents for use herein include propylene glycol derivatives such as n-butoxypropanol or n-butoxypropoxypropanol, water-soluble CARBITOL® solvents or water-soluble CELLOSOLVE® solvents; water-soluble CARBITOL® solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE® solvents are compounds of the 2-alkoxyethoxy ethanol class, with 2-butoxyethoxyethanol being preferred. Other suitable solvents include benzyl alcohol, and diols such as 2-ethyl-1,3-hexanediol and 2,2,4-trimethyl-1,3-pentanediol and mixtures thereof. Some preferred solvents for use herein are n-butoxypropoxypropanol, BUTYL CARBITOL ® and mixtures thereof.

The solvents can also be selected from the group of compounds comprising ether derivatives of mono-, di- and tri-ethylene glycol, propylene glycol, butylene glycol ethers, and mixtures thereof. The molecular weights of these solvents are preferably less than 350, more preferably between 100 and 300, even more preferably between 115 and 250. Examples of preferred solvents include, for example, mono-ethylene glycol n-hexyl ether, mono-propylene glycol n-butyl ether, and tri-propylene glycol methyl ether. Ethylene glycol and propylene glycol ethers are commercially available from the Dow Chemical Company under the tradename "Dowanol" and from the Arco Chemical Company under the tradename "Arcosolv". Other preferred solvents including mono- and di-ethylene glycol n-hexyl ether are available from the Union Carbide company.

Solubilizing agent—The instant compositions may optionally contain about 0 wt. % to about 12 wt. %, more preferably about 1 wt. % to about 10 wt. %, of at least one solubilizing agent which can be a hydrotrope such as sodium xylene sulfonate, or sodium cumene sulfonate, a $C_{2-3}$ mono or dihydroxy alkanols such as ethanol, isopropanol and propylene glycol and mixtures thereof. The solubilizing agents are included in order to control low temperature cloud clear properties. Urea can be optionally employed in the instant composition as a supplemental solubilizing agent at a concentration of 0 to about 10 wt. %, more preferably about 0.5 wt. % to about 8 wt. %. Other suitable solubilizing agents are glycerol, water-soluble polyethylene glycols having a molecular weight of 300 to 600, polypropylene glycol of the formula $HO(CH_3CHCH_2O)_nH$ wherein n is a number from 2 to 18, mixtures of polyethylene glycol and polypropylene glycol (Synalox) and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4. Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate.

Polymeric Soil Release Agent—The compositions according to the present invention may optionally comprise one or more soil release agents. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10% preferably from about 0.1% to about 5%, more preferably from about 0.2% to about 3% by weight, of the composition.

The following, all included herein by reference, describe soil release polymers suitable for us in the present invention. U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,702,857 Gosselink et al., issued Oct. 27, 1987; U.S. Pat. No. 4,711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. No. 4,220,918; U.S. Pat. No. 4,787,989; EP 279,134 A, 1988 to Rhone-Poulenc Chemie; EP 457,205 A to BASF (1991); and DE 2,335,044 to Unilever N. V., 1974; all incorporated herein by reference.

Polymeric Grease release agents—The compositions of the present invention can also optionally contain polymeric grease release agents. Sutable polymer grese release agents include those of the formula:

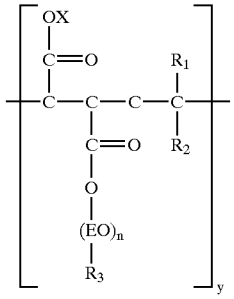

wherein x is hydrogen or an alkali metal cation and n is a number from 2 to 16, $R_1$ is selected from the group consisting of methyl or hydrogen, $R_2$ is a $C_1$ to $C_{12}$, linear or branched chained alkyl group and $R_3$ is a $C_2$ to $C_{16}$, linear or branched chained alkyl group and y is of such value as to provide a molecular weight about 5,000 to about 15,000. See U.S. Pat. No. 5,573,702.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylated amines; liquid detergent compositions typically contain about 0.01% to about 5%.

A preferred soil release and anti-redeposition agent is ethoxylated tetraethylene pentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. See U.S. Pat. No. 4,891,160, VanderMeer, issued Jan. 2, 1990 and WO 95/32272, published Nov. 30, 1995. Another type of preferred antiredeposition agent includes the carboxy methyl cellulose (CMC) materials. These materials are well known in the art.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release, peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Other polymer types which may be more desirable for biodegradability, improved bleach stability, or cleaning purposes include various terpolymers and hydrophobically modified copolymers, including those marketed by Rohm & Haas, BASF Corp., Nippon Shokubai and others for all manner of water-treatment, textile treatment, or detergent applications.

Chelating Agents—The compositions herein may also optionally contain one or chelating agents, particularly chelating agents for adventitious transition metals. Those commonly found in wash water include iron and/or manganese in water-soluble, colloidal or particulate form, and may be associated as oxides or hydroxides, or found in association with soils such as humic substances. Preferred chelants are those which effectively control such transition metals, especially including controlling deposition of such transition-metals or their compounds on fabrics and/or controlling undesired redox reactions in the wash medium and/or at fabric or hard surface interfaces. Such chelating agents include those having low molecular weights as well as polymeric types, typically having at least one, preferably two or more donor heteroatoms such as O or N, capable of co-ordination to a transition-metal. Common chelating agents can be selected from the group consisting of aminocarboxylates, aminophosphonates, polyfunctionally-substituted aromatic chelating agents and mixtures thereof.

Amino carboxylates useful as optional chelating agents include ethylenediaminetetrace-tates, N-hydroxyethylethylenediaminetriacetates, nitrilotriacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

If utilized, chelating agents will generally comprise from about 0.001% to about 15% by weight of the detergent compositions herein. More preferably, if utilized, chelating agents will comprise from about 0.01% to about 3.0% by weight of such compositions.

Suds Suppressors—Compounds for reducing or suppressing the formation of suds can be incorporated into the compositions of the present invention when required by the intended use, especially washing of laundry in washing appliances. Other compositions, such as those designed for hand-washing, may desirably be high-sudsing and may omit such ingredients Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors and are well known in the art. See, for example, Kirk Othmer Encyclopedia of Chemical Technology, Third Edition, Volume 7, pages 430–447 (Wiley, 1979).

The compositions herein will generally comprise from 0% to about 10% of suds suppressor. Who utilized as suds suppressors, monocarboxylic fatty acids, and salts thereof, will be present typically in amounts up to about 5%, preferably 0.5%–3% by weight, of the detergent composition, although higher amounts may be used. Preferably from about 0.01% to about 1% of silicone suds suppressor is used, more preferably from about 0.25% to about 0.5%. These weight percentage values include any silica that may be utilized in combination with polyorganosiloxane, as well as any suds suppressor adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Alkoxylated Polycarboxylates—Alkoxylated polycarboxylates such as those prepared from polyacrylates are useful herein to provide additional grease removal performance. Such materials are described in WO 91/08281 and PCT 90/01815 at p. 4 et seq., incorporated herein by reference. Chemically, these materials comprise polyacrylates having one ethoxy side-chain per every 7–8 acrylate units. The side-chains are of the formula $—CH_2CH_2O)_m(CH_2)_nCH_3$ wherein m is 2–3 and n is 6–12. The side-chains are ester-linked to the polyacrylate "backbone" to provide a "comb" polymer type structure. The molecular weight can vary, but is typically in the range of about 2000 to about 50,000. Such alkoxylated polycarboxylates can comprise from about 0.05% to about 10%, by weight, of the compositions herein.

Perfumes—Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes typically comprise from about 0.01% to about 2%, by weight, of the detergent compositions herein, and individual perfumery ingredients can comprise from about 0.0001% to about 90% of a finished perfume composition.

Non-limiting examples of perfume ingredients useful herein include: 7-acetyl-1,2,3,4,5,6,7,8-octahydro-1,1,6,7-tetramethyl naphthalene; ionone methyl; ionone gamma methyl; methyl cedrylone; methyl dihydrojasmonate; methyl 1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; para-hydroxy-phenylbutanone; benzophenone; methyl beta-naphthyl ketone; 6-acetyl-1,1,2,3,3,5-hexamethyl indane; 5-acetyl-3-isopropyl-1,1,2,6-tetramethyl indane; 1-dodecanal, 4-(4-hydroxy-4-methylpentyl)-3-cyclohexene-1-carboxaldehyde; 7-hydroxy-3,7-dimethyl ocatanal; 10-undecen-1-al; iso-hexenyl cyclohexyl carboxaldehyde; formyl tricyclodecane; condensation products of hydroxycitronellal and methyl anthranilate, condensation products of hydroxycitronellal and indol, condensation products of phenyl acetaldehyde and indol; 2-methyl-3-(para-tert-butylphenyl)-propionaldehyde; ethyl vanillin; heliotropin; hexyl cinnamic aldehyde; amyl cinnamic aldehyde; 2-methyl-2-(para-iso-propylphenyl)-propionaldehyde; coumarin; decalactone gamma; cyclopentadecanolide; 16-hydroxy-9-hexadecenoic acid lactone; 1,3,4,6,7,8-hexahydro-4,6,6,7,8,8-hexamethylcyclopenta-gamma-2-benzo-pyrane; beta-naphthol methyl ether; ambroxane; dodecahydro-3a,6,6,9a-tetramethyl-naphtho[2,1b]furan; cedrol, 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; tricyclodecenyl propionate; tricyclodecenyl acetate; benzyl salicylate; cedryl acetate; and para-(tert-butyl) cyclohexyl acetate.

Particularly preferred perfume materials are those that provide the largest odor improvements in finished product compositions containing cellulases. These perfumes include but are not limited to: hexyl cinnamic aldehyde; 2-methyl-3-(para-tert-butylphenyl)propionaldehyde; 7-acetyl-1,2,3,4,5,6,7,8-octahydro-1,1,6,7-tetramethyl naphthalene; benzyl salicylate; 7-acetyl-1,1,3,4,4,6-hexamethyl tetralin; para-tert-butyl cyclohexyl acetate; methyl dihydro jasmonate; beta-napthol methyl ether, methyl beta-naphthyl ketone; 2-methyl-2-(para-iso-propylphenyl)-propionaldehyde; 1,3,4,6,7,8-hexahydro-4,6,6,7,8,8-hexamethyl-cyclopenta-gamma-2-benzopyrane; dodecahydro-3a,6,6,9a-tetramethylnaphtho[2,1b]furan; anisaldehyde; coumarin; cedrol; vanillin; cyclopentadecanolide; tricyclodecenyl acetate; and tricyclodecenyl propionate.

Other perfume materials include essential oils, resinoids, and resins from a variety of sources including, but not limited to: Peru balsam, Olibanum resinoid, styrax, labdanum resin, nutmeg, cassia oil, benzoin resin, coriander and lavandin. Still other perfume chemicals include phenyl ethyl alcohol, terpineol, linalool, linalyl acetate, geraniol, nerol, 2-(1,1-dimethylethyl)cyclohexanol acetate, benzyl acetate, and eugenol. Carriers such as diethylphthalate can be used in the finished perfume compositions.

In place of the perfume, especially in microemulsions, the compositions can employ an essential oil or a water insoluble organic compound such as a water insoluble hydrocarbon having 6 to 18 carbon such as a paraffin or isoparaffin such as isoparH, isodecane, alpha-pinene, beta-pinene, decanol and terpineol. Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69.degree. C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchpouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen.

Composition pH—Dishwashing compositions of the invention will be subjected to acidic stresses created by food soils when put to use, i.e., diluted and applied to soiled dishes. If a composition with a pH greater than 7 is to be more effective, it may optionally contain a buffering agent capable of providing a generally more alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 10. Under these conditions the buffering agent most effectively controls the pH while using the least amount thereof.

It is prefered that the compositions of the present invention has a pH (as measured as 10% aqueous solution) from about 2.0 to about 12.5, more preferably from about to about, even more preferably from about to about.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials Some examples are amino acids such as lysine or lower alcohol amines like mono-, di-, and tri-ethanolamine. Other preferred nitrogen-containing buffering agents are Tri (hydroxymethyl)amino methane (HOCH2)3CNH3 (TRIS), 2-amino-2-ethyl-1,3-propanediol, 2-amino-2-methyl-propanol, 2-amino-2-methyl-1,3-propanol, disodium glutamate, N-methyl diethanolamide, 1,3-diamino-propanol N,N'-tetra-methyl-1,3-diamino-2-propanol, N,N-bis(2-hydroxyethyl)glycine (bicine) and N-tris (hydroxymethyl) methyl glycine (tricine). Mixtures of any of the above are also acceptable. Useful inorganic buffers/alkalinity sources include the alkali metal carbonates and alkali metal phosphates, e.g., sodium carbonate, sodium polyphosphate. For additional buffers see McCutcheon's EMULSIFIERS AND DETERGENTS, North American Edition, 1997, McCutcheon Division, MC Publishing Company Kirk and WO 95/07971 both of which are incorporated herein by reference.

The composition will preferably contain at least about 0.1%, more preferably at least about 1%, even more preferably still, at least about 2% by weight of the composition of buffering agent. The composition will also preferably contain no more than about 15%, more preferably no more than about 10%, even more preferably, no more than about 8% by weight of the composition of buffering agent.

Hydrotropes—The aqueous liquid carrier may comprise one or more materials which are hydrotropes. Hydrotropes suitable for use in the compositions herein include the $C_1$–$C_3$ alkyl aryl sulfonates, $C_6$–$C_{12}$ alkanols, $C_1$–$C_{16}$ carboxylic sulfates and sulfonates, urea, $C_1$–$C_{16}$ hydrocarboxylates, $C_1$–$C_4$ carboxylates, $C_2$–$C_4$ organic diacids and mixtures of these hydrotrope materials. The liquid detergent composition of the present invention preferably comprises from about 0.5% to 8%, by weight of the liquid detergent composition of a hydrotrope selected from alkali metal and calcium xylene and toluene sulfonates.

Suitable $C_1$–$C_3$ alkyl aryl sulfonates include sodium, potassium, calcium and ammonium xylene sulfonates; sodium, potassium, calcium and ammonium toluene sulfonates; sodium, potassium, calcium and ammonium cumene sulfonates; and sodium, potassium, calcium and ammonium substituted or unsubstituted naphthalene sulfonates and mixtures thereof.

Suitable $C_1$–$C_8$ carboxylic sulfate or sulfonate salts are any water soluble salts or organic compounds comprising 1 to 8 carbon atoms (exclusive of substituent groups), which are substituted with sulfate or sulfonate and have at least one carboxylic group. The substituted organic compound may be cyclic, acrylic or aromatic, i.e. benzene derivatives. Preferred alkyl compounds have from 1 to 4 carbon atoms substituted with sulfate or sulfonate and have from 1 to 2 carboxylic groups. Examples of this type of hydrotrope include sulfosuccinate salts, sulfophthalic salts, sulfoacetic salts, m-sulfobenzoic acid salts and diester sulfosuccinates, preferably the sodium or potassium salts as disclosed in U.S. Pat. No. 3,915,903.

Suitable $C_1$–$C_4$ hydrocarboxylates and $C_1$–$C_4$ carboxylates for use herein include acetates and propionates and citrates. Suitable $C_2$–$C_4$ diacids for use herein include succinic, glutaric and adipic acids.

Other compounds which deliver hydrotropic effects suitable for use herein as a hydrotrope include $C_6$–$C_{12}$ alkanols and urea.

Preferred hydrotropes for use herein are sodium, potassium, calcium and ammonium cumene sulfonate; sodium, potassium, calcium and ammonium xylene sulfonate; sodium, potassium, calcium and ammonium toluene sulfonate and mixtures thereof. Most preferred are sodium cumene sulfonate and calcium xylene sulfonate and mixtures thereof These preferred hydrotrope materials can be present in the composition to the extent of from about 0.5% to 8% by weight The composition will preferably contain at least about 0.1%, more preferably at least about 0.2%, even more preferably still, at least about 0.5% by weight of the composition of hydrotrope. The composition will also preferably contain no more than about 15%, more preferably no more than about 10%, even more preferably, no more than about 8% by weight of the composition of hydrotrope.

Other Ingredients—The detergent compositions may further preferably comprise one or more detersive adjuncts selected from the following: soil release polymers, polymeric dispersants, polysaccharides, abrasives, bactericides, tarnish inhibitors, color stabilizers, dyes, electrolytes(such as NaCl etc), antifungal or mildew control agents, insect repellents, acaricidal agents hydrotropes, processing aids, suds boosters, brighteners, anti-corrosive aids and stabilizers antioxidants. A wide variety of other ingredients useful in detergent compositions can be included in the compositions herein, including other active ingredients, carriers, antioxidants, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the detergent compositions of the present invention. They can be any conventional antioxidant used in detergent compositions, such as 2,6-di-tert-butyl-4-methylphenol (BHT), carbanate, ascorbate, thiosulfate, monoethanolamine(MEA), diethanolamine, triethanolamine, etc. It is preferred that the antioxidant, when present, be present in the composition from about 0.001% to about 5% by weight.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Form of the Composition

The compositions herein can be in any of the conventional forms for hand dishwashing compositions, such as, paste, liquid, granule, powder, gel, liqui-gel, microemulsion liquid crystal and mixtures thereof. Highly preferred embodiments are in liquid or gel form. The liquid compositions can be either aqueous or nonaqueous. When the composition is a aqueous liquid the composition will preferably further contain an aqueous liquid carrier in which the other essential and optional compositions components are dissolved, dispersed or suspended.

When the composition is an aqueous liquid the composition will preferably contain at least about 50%, more preferably at least about 10%, even more preferably still, at least about 30% by weight of the composition of aqueous liquid carrier. The composition will also preferably contain no more than about 95%, more preferably no more than about 60%, even more preferably, no more than about 50% by weight of the composition of aqueous liquid carrier.

One essential component of the aqueous liquid carrier is, of course, water. The aqueous liquid carrier, however, may contain other materials which are liquid, or which dissolve in the liquid carrier, at room temperature and which may also serve some other function besides that of a simple filler. Such materials can include, for example, hydrotropes and solvents. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used.

An example of the procedure for making granules of the detergent compositions herein is as follows:—the modified aklylbenzenesulfonate, citric acid, sodium silicate, sodium sulfate perfume, diamine and water are added to, heated and mixed via a crutcher. The resulting slurry is spray dried into a granular form.

An example of the procedure for making liquid detergent compositions herein is as follows:—To the free water and citrate are added and dissolved. To this solution amine oxide, betaine, ethanol, hydrotrope and nonionic surfactant are added. If free water isn't available, the citrate are added to the above mix then stirred until dissolved. At this point, an acid is added to neutralize the formulation. It is preferred that the acid be chosen from organic acids such as maleic and citric, however, inorganic mineral acids may be employed as well. In preferred embodiments these acids are added to the formulation followed by diamine addition. AExS is added last.

Non-aqueous Liquid Detergents

The manufacture of liquid detergent compositions which comprise a non-aqueous carrier medium can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. No. 4,988,462; U.S. Pat. No. 5,266,233; EP-A-225,654 (Jun. 16, 1987); EP-A-510,762 (Oct. 28,1992); EP-A-540,089 (May 5, 1993); EP-A-540,090 (May 5, 1993); U.S. Pat. No. 4,615,820; EP-A-565,017 (Oct. 13, 1993); EP-A-030,096 (Jun. 10, 1981), incorporated herein by reference. Such compositions can contain various particulate detersive ingredients stably suspended therein. Such non-aqueous compositions thus comprise a LIQUID PHASE and, optionally but preferably, a SOLID PHASE, all as described in more detail hereinafter and in the cited references.

The compositions of this invention can be used to form aqueous washing solutions for use hand dishwashing. Generally, an effective amount of such compositions is added to water to form such aqueous cleaning or soaking solutions. The aqueous solution so formed is then contacted with the dishware, tableware, and cooking utensils.

An effective amount of the detergent compositions herein added to water to form aqueous cleaning solutions can comprise amounts sufficient to form from about 500 to 20,000 ppm of composition in aqueous solution. More preferably, from about 800 to 5,000 ppm of the detergent compositions herein will be provided in aqueous cleaning liquor.

The following examples are illustrative of the present invention, but are not meant to limit or otherwise define its scope. All parts, percentages and ratios used herein are expressed as percent weight unless otherwise specified.

In the following Examples all levels are quoted as % by weight of the composition.

Detergent Composition Examples

In these Examples, the following abbreviation is used for a Crystallinity disrupted alkylbenzene sulfonate, sodium salt form or potassiun salt form, prepared according to any of the preceding process examples: MLAS The following abbreviations are used for cleaning product adjunct materials:

| | |
|---|---|
| Cxy Amine Oxide | Alkyldimethylamine N-Oxide RN(O)Me2 of given chainlength Cxy where average total carbon range of the non-methyl alkyl moiety R is from 10 + x to 10 + y |
| Cxy APG | alkylpolyglycosides of the formula R2O(CnH2nO)t(glycosyl)x of given chainlength Cxy where R2 is a $C_{10-18}$ alkyl; n is 2 or 3, t is from 0 to about 10, preferably 0; and x is from about 1.3 to about 2.7. The glycosyl is preferably derived from glucose. |
| Amylase | Amylolytic enzyme of activity 60 KNU/g sold by NOVO Industries A/S under the tradename Termamyl 60T. Alternatively, the amylase is selected from: |

-continued

| | |
|---|---|
| | Fungamyl ®; Duramyl ®; BAN ®; and α amylase enzymes described in WO95/26397 and in co-pending application by Novo Nordisk PCT/DK96/00056. |
| APA | C8–C10 amido propyl dimethyl amine |
| Cxy Betaine | Alkyldimethyl Betaine having an average total carbon range of alkyl moiety from 10 + x to 10 + y |
| Calcium Salt | Calcium chloride, Calcium sulfate, Calcium hydroxide, and mixture thereof |
| Carbonate | $Na_2CO_3$ anhydrous, 200 μm–900 μm |
| Citrate | Trisodium citrate dihydrate, 86.4%, 425 μm–850 μm |
| Citric Acid | Citric Acid, Anhydrous |
| CMC | Sodium carboxymethyl cellulose |
| CxyAS | Alkyl sulfate, Na salt or other salt if specified having an average total carbon range of alkyl moiety from 10 + x to 10 + y |
| CxyEz | Commercial linear or branched alcohol ethoxylate (not having mid-chain methyl branching) and having an average total carbon range of alkyl moiety from 10 + x to 10 + y average z moles of ethylene oxide |
| CxyEzS | Alkyl ethoxylate sulfate, Na salt (or other salt if specified) having an average total carbon range of alkyl moiety from 10 + x to 10 + y and an average of z moles of ethylene oxide |
| DEA | diethanolamine |
| Diamine | Alkyl diamine, e.g., 1,3 propanediamine, Dytek EP, Dytek A, (Dupont) or selected from: dimethyl aminopropyl amine; 1,6-hexane diamine; 1,3 propane diamine; 2-methyl 1,5 pentane diamine; 1,3-pentanediamine; 1-methyl-diaminopropane; 1,3 cyclohexane diamine; 1,2 cyclohexane diamine; 1,3-bis(methylamine)-cyclohexane |
| DTPA | Diethylene triamine pentaacetic acid |
| DTPMP | Diethylene triamine penta (methylene phosphonate), Monsanto (Dequest 2060) |
| EtOH | Ethanol |
| Hydrotrope | selected from sodium, potassium, Magnesium, Calcium, ammonium or water-soluble substituted ammonium salts of toluene sulfonic acid, naphthalene sulfonic acid, cumene sulfonic acid, xylene sulfonic acid. |
| LAS | Linear Alkylbenzene Sulfonate (e.g., C11.8, Na or K salt) |
| Lipase | Lipolytic enzyme, 100 kLU/g, NOVO, Lipolase ®. Alternatively, the lipase is selected from: Amano-P; M1 Lipase ®; Lipomax ®; D96L-lipolytic enzyme variant of the native lipase derived from *Humicola lanuginosa* as described in US Serial No. 08/341,826; and the *Humicola lanuginosa* strain DSM 4106. |
| LMFAA | C12–14 alkyl N-methyl glucamide |
| MA/AA | Copolymer 1:4 maleic/acrylic acid, Na salt, avg. mw. 70,000. |
| MBAxEy | Mid-chain branched primary alkyl ethoxylate (average total carbons = x; average EO = y) |
| MBAxEyS | Mid-chain branched or modified primary alkyl ethoxylate sulfate, Na salt (average total carbons = x; average EO = y) according to the invention (see Example 9) |
| MBAyS | Mid-chain branched primary alkyl sulfate, Na salt (average total carbons = y) |
| MEA | Monoethanolamine |
| Cxy MES | Alkyl methyl ester sulfonate, Na salt having an average total carbon range of alkyl moiety from 10 + x to 10 + y |
| Magnesium Salt | Magnesium chloride, Magnesium sulfate, magnesium hydroxide, and mixtures thereof |
| NaOH | Sodium hydroxide |
| Cxy NaPS | Paraffin sulfonate, Na salt having an average total carbon range of alkyl moiety from 10 + x to 10 + y |
| NaTS | Sodium toluene sulfonate |
| PAA | Polyacrylic Acid (mw = 4500) |
| PAE | Ethoxylated tetraethylene pentamine |
| PEG | Polyethylene glycol (mw = 4600) |
| PG | Propanediol |
| Protease | Proteolytic enzyme, 4 KNPU/g, NOVO, Savinase ® ®. Alternatively, the protease is selected from: Maxatase ®; Maxacal ®; Maxapem |

-continued

| | |
|---|---|
| | 15 ®; subtilisin BPN and BPN'; Protease B; Protease A; Protease D; Primase ®; Durazym ®; Opticlean ®; and Optimase ®; and Alcalase ®. |
| Cxy SAS | Secondary alkyl sulfate, Na salt having an average total carbon range of alkyl moiety from 10 + x to 10 + y |
| Silicate | Sodium Silicate, amorphous ($SiO_2$:$Na_2O$; 2.0 ratio) |
| Solvent | hexylene glycol, ethanol, or propylene glycol |
| STPP | Sodium tripolyphosphate, anhydrous |
| Suds boosting polymer | (N,N-dimethylamino)alkyl acrylate; (N,N-dimethylamino)ethyl methacrylate homopolymer; Dimethylaminoethyl methacrylate/dimethylacrylamide copolymers; Poly(DMAM) homolymer; Poly(DMAM-co-AA) (2:1) Copolymer; Polypeptide comprising Lys, Ala, Glu, Tyr (5:6:2:1) having a molecular weight of approximately 52,000 daltons; |
| Sulfate | Sodium sulfate, anhydrous |
| TFA | C16–18 alkyl N-methyl glucamide |

Typical ingredients often referred to as "minors" can include perfumes, dyes, pH trims etc.

The following example is illustrative of the present invention, but is not meant to limit or otherwise define its scope. All parts, percentages and ratios used are expressed as percent weight unless otherwise noted.

EXAMPLE 6

| Ingredient | Wt. % A | Wt. % B | Wt. % C | Wt. % D |
|---|---|---|---|---|
| MLAS | 5 | 10 | 20 | 30 |
| Mid-Branched C12–13 alkyl ethoxylate (9 moles EO) | 1 | 1 | 1 | 1 |
| Sodium $C_{12-13}$ alkyl ethoxy (1–3) sulfate | 25 | 20 | 10 | 0 |
| $C_{12-14}$ Glucose Amide | 4 | 4 | 4 | 4 |
| Coconut amine oxide | 4 | 4 | 4 | 4 |
| EO/PO Block Co-polymer-Tetronic ® 704 | 0.5 | 0.5 | 0.5 | 0.5 |
| Ethanol | 6 | 6 | 6 | 6 |
| Hydrotrope | 5 | 5 | 5 | 5 |
| Magnesium$^{++}$ Salt | 3.0 | 3.0 | 3.0 | 3.0 |
| Water, thickeners and minors | to 100% | to 100% | to 100% | to 100% |
| pH @ 10% (as made) | 7.5 | 7.5 | 7.5 | 7.5 |

EXAMPLE 7

| | A | B | C |
|---|---|---|---|
| pH 10% | 9 | 10 | 10 |
| MLAS | 30 | 28 | 25 |
| Amine Oxide (C12–14) | 5 | 3 | 7 |
| Betaine | 3 | 0 | 1 |
| Polyhydroxy fatty acid amide (C14) | 0 | 1.5 | 0 |
| AE nonionic | 2 | 0 | 4 |
| Diamine | 1 | 5 | 7 |
| Magnesium Salt | 0.25 | 0.2 | 0.5 |
| Citrate (cit2K3) | 0.25 | 0 | 0 |
| Total (perfumes, dye, water, ethanol, etc.) | | (to 100%) | |

| | D | E | F |
|---|---|---|---|
| pH 10% | 9.3 | 8.5 | 11 |
| MLAS | 10 | 15 | 10 |
| Paraffin Sulfonate | 10 | 0 | 0 |
| Linear Alkyl Benzene Sulfonate | 5 | 15 | 12 |
| Betaine | 3 | 1 | 0 |
| Polyhydroxy fatty acid amide (C12) | 3 | 0 | 1 |
| AE nonionic | 0 | 0 | 20 |
| DTPA | 0 | 0.2 | 0 |

-continued

| | | | |
|---|---|---|---|
| Citrate (as Cit2K3) | 0.7 | 0 | 0 |
| Diamine | 1 | 5 | 7 |
| Magnesium Salt | 1 | 0 | 0 |
| Calcium Salt | 0 | 0.5 | 0.2 |
| Protease | 0.01 | 0 | 0.05 |
| Amylase | 0 | 0.05 | 0.05 |
| Hydrotrope | 2 | 1.5 | 3 |
| Total (perfumes, dye, water, ethanol, etc.) | | (to 100%) | |

EXAMPLE 8

| | A | B | C | D | E | F |
|---|---|---|---|---|---|---|
| pH 10% | 8.5 | 9 | 9.0 | 9.0 | 8.5 | 8.0 |
| MLAS | 10 | 5 | 5 | 15 | 10 | 5 |
| Mid-branched alcohol ethoxy (0.6) Sulfate | 0 | 0 | 0 | 10 | 0 | 0 |
| Mid-branched alcohol ethoxy (1) Sulfate | 0 | 25 | 0 | 0 | 0 | 25 |
| Mid-branched alcohol ethoxy (1.4) Sulfate | 20 | 0 | 27 | 0 | 20 | 0 |
| Mid-branched alcohol ethoxy (2.2) Sulfate | 0 | 0 | 0 | 10 | 0 | 0 |
| Amine Oxide | 5 | 5 | 5 | 3 | 5 | 5 |
| Betaine | 3 | 3 | 0 | 0 | 3 | 3 |
| AE nonionic | 2 | 2 | 2 | 2 | 2 | 2 |
| Diamine | 1 | 2 | 0 | 0 | 0 | 0 |
| Magnesium Salt | 0.25 | 0.25 | 0.01 | 0.3 | 0.25 | 0.2 |
| Hydrotrope | 0 | 0.4 | 0 | 0 | 0 | 0 |
| Total (perfumes, dye, water, ethanol, etc.) | | | (to 100%) | | | |

| | G | H | I | J | K | L |
|---|---|---|---|---|---|---|
| pH 10% | 9.3 | 8.5 | 11 | 10 | 9 | 9.2 |
| Mid-branched alcohol ethoxy (0.6) Sulfate | 10 | 15 | 10 | 25 | 5 | 10 |
| Paraffin Sulfonate | 10 | 0 | 0 | 0 | 0 | 0 |
| LAS | 0 | 0 | 0 | 0 | 7 | 10 |
| MLAS | 5 | 15 | 12 | 2 | 7 | 10 |
| Betaine | 3 | 1 | 0 | 2 | 2 | 0 |
| Amine Oxide | 0 | 0 | 0 | 2 | 5 | 7 |
| Polyhydroxy fatty acid amide (C12) | 3 | 0 | 1 | 2 | 0 | 0 |
| AE nonionic | 0 | 0 | 20 | 1 | 0 | 2 |
| Hydrotrope | 0 | 0 | 0 | 0 | 0 | 5 |
| Diamine | 1 | 5 | 7 | 2 | 2 | 5 |
| Magnesium Salt | 1 | 0 | 0.2 | 0.3 | 0 | 0 |
| Calcium Salt | 0 | 0.5 | 0 | 0 | 0.1 | 0.1 |
| Protease | 0.1 | 0 | 0 | 0.05 | 0.06 | 0.1 |
| Amylase | 0 | 0.07 | 0 | 0.1 | 0 | 0.05 |
| Lipase | 0 | 0 | 0.025 | 0 | 0.05 | 0.05 |
| DTPA | 0 | 0.3 | 0 | 0 | 0.1 | 0.1 |
| Citrate (Cit2K3) | 0.65 | 0 | 0 | 0.3 | 0 | 0 |
| Total (perfumes, dye, water, ethanol, etc.) | | | (to 100%) | | | |

EXAMPLE 9

| | A | B | C | D | E |
|---|---|---|---|---|---|
| pH 10% | 8.5 | 9 | 10 | 10 | 10 |
| LAS | 0 | 0 | 0 | 15 | 0 |
| MLAS | 30 | 30 | 27 | 15 | 33 |
| Amine Oxide | 5 | 5 | 5 | 3 | 6 |
| Betaine | 3 | 3 | 0 | 0 | 0 |
| AE nonionic | 2 | 2 | 2 | 2 | 4 |
| Diamine | 1 | 2 | 4 | 4 | 5 |
| K Citrate | 0.25 | 0.5 | 0 | 3.5 | 2 |
| Maleic Acid | 0.5 | 1 | 3 | 0 | 2 |
| Magnesium Salt | 0.25 | 0.25 | 0.01 | 0.02 | 0.2 |
| Hydrotrope | 0 | 0.4 | 0 | 0 | 0 |
| Total (perfumes, dye, water, ethanol, etc.) | | | (to 100%) | | |

-continued

Example 10

| | A | B | C | D | E |
|---|---|---|---|---|---|
| $C_{12}E_{1.5}S$ | — | 9.66 | 9.3 | 22.4 | 2.0 |
| MLAS | 11.2 | 13.71 | 20.4 | 13.4 | 12.8 |
| Nonionic | 0.158 | — | — | | 0.2 |
| Mg salt | 0.4 | 0.19 | 0.17 | 0.14 | 0.4 |
| Hydrotrope | | — | — | 2.31 | — |
| MEA/DEA | 0.1 | 1.07 | 2.3 | 1.4 | — |
| Antibacterial agent | — | 0.14 | — | | — |
| Solvent | | — | 2.6 | 4.5 | — |
| Water and minors | qs to 100% | qs to 100% | qs to 100% | qs to 100% | qs to 100% |
| 10% pH | 6.67 | 7.3 | 7.3 | 7.47 | 5.23 |

Example 11

| | A | B | C | D | E |
|---|---|---|---|---|---|
| $C_{12}E_{1.5}S$ | 4 | — | | 6.7 | |
| $C_{12}E_{2.9}S$ | — | — | 2.2 | — | 14.3 |
| $C_{12}E_{3.7}S$ | — | — | — | — | |
| MLAS | 7 | 25 | 17.8 | 0.6 | 6.0 |
| Nonionic | — | | 2.3 | | |
| Amine Oxide | | | | | 7.1 |
| Citrate | | | | | 0.8 |
| APG | | | | | 16.6 |
| Betaine | — | | | | |
| Mg salt | 0.1 | 0.2 | 0.01 | 0.8 | 0.3 |
| NaCl | — | | | | |
| Soap | 1 | | | | |
| Hydrotrope | — | | | | 4.3 |
| MEA/DEA | 0.1 | | 1.4 | 0.1 | 3.7 |
| Antibacterial agent | — | | | 0.06 | |
| Na2CO3 | — | 11.0 | | | |
| Silicate | | 2.0 | | | |
| Na2SO4 | 4.0 | 26.0 | | | 0.3 |
| Solvent | — | — | 1.6 | | 5.2 |
| Water and minors (perfume etc) | qs to 100% | qs to 100% | qs to 100% | qs to 100% | qs to 100% |
| form of composition | liquid | paste | gel | liquid | liquid |

Example 12

| | A | B | C | D |
|---|---|---|---|---|
| $C_{12}E_{2.9}S$ | 4.0 | 2.0 | — | |
| $C_{12}E_{1.5}S$ | 4.0 | 2.0 | 9.0 | 22.0 |
| MLAS | 2.0 | 4.0 | 26.7 | 1.35 |
| $C_{12}E_{2.9}$ | 20.6 | 20.6 | | |
| MEA | 1.4 | 1.4 | 2.0 | 1.5 |
| Hydrotrope | 1.1 | 1.1 | 3.0 | 2.5 |
| APG | — | — | 1.5 | 11 |
| polymeric thickener | — | — | 0.5 | |
| Betaine | 5.4 | 5.4 | | |
| NaCl | 1.1 | 1.1 | | |
| Solvent | — | — | | 4.5 |
| Mg salt | 0.11 | 0.11 | 0.2 | 0.75 |
| perfume | 0.2 | 0.2 | 0.3 | 0.25 |
| Water and minors | qs to 100% | qs to 100% | qs to 100% | qs to 100% |
| pH of 10% solution | 4.9 | 4.9 | 7.5 | 7.5 |

Example 13

| | A | B | C | D | E |
|---|---|---|---|---|---|
| AE0.6S | 6 | 10 | 13 | 15 | 20 |
| Amine oxide | 6.5 | 6.5 | 7.5 | 7.5 | 7.5 |
| C10E8 | 3 | 3 | 4.5 | 4.5 | 4.5 |
| MLAS | 20 | 16 | 13 | 11 | 6 |
| Diamine | 0.5 | 0.5 | 1.25 | 1 | 0 |
| Magnesium salt | 0.2 | 0.4 | 1.0 | 0.1 | 0.2 |
| Suds boosting polymer | 0 | 0.2 | 0.5 | 0.2 | 0.5 |
| Hydrotrope | 1.5 | 1.5 | 1 | 1 | 1 |
| Ethanol | 8 | 8 | 8 | 8 | 8 |

-continued

| | | | | | |
|---|---|---|---|---|---|
| Sodium Chloride | 0.5 | 0.5 | 0 | 0 | 0.2 |
| pH | 9 | 9 | 9 | 8 | 10 |

| | F | G | H | I |
|---|---|---|---|---|
| AE0.6S | 6 | 10 | 13 | 20 |
| Amine oxide | 6.50 | 6.50 | 6.50 | 7.20 |
| MLAS | 20 | 16 | 13 | 11 |
| Suds boosting | 0.20 | 0.20 | 0.20 | 0.22 |
| polymer | 1.50 | 1.50 | 3.50 | 2.0 |
| Hydrotrope | 1 | 1 | 1 | 1 |
| Polypropylene glycol (MW 2700) | | | | |
| C10E8 | 3.00 | 3.00 | 3.00 | 3.30 |
| Diamine | 0.50 | 0 | 0 | 0.55 |
| Magnesium Salt | 0.22 | 0.3 | 0.5 | 0.25 |
| Sodium chloride | 0.5 | — | 0.5 | — |
| Water and Misc. | BAL. | BAL. | BAL. | BAL. |
| Viscosity (cps @ 70F) | 150 | 330 | 650 | 330 |
| pH @ 10% | 8.3 | 9.0 | 9.0 | 9.0 |

| | J | K |
|---|---|---|
| AE0.6S | 14.8 | 20 |
| MLAS | 14 | 8 |
| Amine oxide | 7.20 | 7.20 |
| Citric acid | 3.00 | — |
| Maleic acid | — | 2.50 |
| Magnesium Salt | 0.22 | 0.1 |
| Sodium chloride | 0.5 | — |
| Suds boosting polymer | 0.22 | 0.22 |
| Sodium Cumene Sulfonate | 3.30 | 3.30 |
| Ethanol | 6.50 | 6.50 |
| C10E8 | — | — |
| C11E9 | 3.33 | 3.33 |
| Diamine | 0.55 | 0.55 |
| Perfume | 0.31 | 0.31 |
| Water | BAL. | BAL. |
| Viscosity (cps @ 70F) | 330 | 330 |
| pH @ 10% | 9.0 | 9.0 |

Example 14

| | A | B | C | D | E |
|---|---|---|---|---|---|
| MLAS | 14.2 | 14.3 | 6.5 | 13.1 | 10 |
| AE1S | — | — | — | 21.3 | 14 |
| AE0.8S | — | 16.8 | 20.5 | | |
| AS | 9.6 | — | — | | |
| AE3S | 11.4 | | | | |
| APG | — | — | — | 10 | 7 |
| Amide MEA | 4.0 | 3.8 | 3.8 | | |
| MEA/DEA | | | | 2.9 | 2 |
| Betaine | — | — | 1.5 | | |
| C10E8 | — | 4.0 | 4.0 | | |
| Mg salt | 0.3 | 0.29 | 0.35 | 0.2 | 0.3 |
| Water and minors | qs to 100% | qs to 100% | qs to 100% | qs to 100% | qs to 100% |

What is claimed is:

1. A hand dishwashing composition comprising:

A) from 0.1% to 99.9% by weight, of a surfactant system comprising:

i) from 10% to 80% by weight of said surfactant system, of of two or more alkylarysulfonate surfactants of formula:

$$(B—Ar—D)_a(M^{q+})_b$$

wherein D is $—SO_3^-$, M is a cation, q is the cation valence, a and b are numbers having values which provide said surfactant with charge neutrality; Ar is selected from benzene, toluene, and mixtures thereof; B comprises a $C_2$–$C_{20}$ hydrocarbyl moiety and a crystallinity-disrupted moiety; said crystallinity-disrupted moiety interrupts or branches from said hydrocarbyl moiety and is selected from the group consisting of:

I) one or more branches selected from $C_1$–$C_3$ alkyl, $C_1$–$C_3$ alkoxy, hydroxy, and mixtures thereof;

II) one or more interrupts selected from the group consisting of —O—, $—OSi(CH_3)_2O—$, $—SO_3—$, and mixtures thereof;

wherein said surfactant system has a Sodium Critical Solubility Temperature of 40° C. or less; and at least one of the following:

a) modified SCAS test biodegradation which exceeds the value obtained for tetrapropylene benzene sulfonate; or b) a ratio of at least 5:1 by weight, of non-quaternary carbon atoms to quaternary carbon atoms which comprise B:

ii) from 0.1% to 20% by weight, of an amine oxide selected from the formula $$R^3(OR^4)_xN(\overset{O}{\overset{\|}{}})(R^5)_z$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^3$ is an alkyl or hydroxyalkyl group containing from about 1 to about 3 carbon atoms or a polyethylene oxide group containing from about 1 to about 3 ethylene oxide groups wherein the amino oxide comprises from 0 to 40 ppm hydrogen peroxide and from 0 to 40 ppm amine impurities;

iii) optionally one or more detersive surfactants other than (i) and (ii) wherein the one or more detersive surfactants comprises 0 to 40 ppm hydrogen peroxide;

B) a diamine substantially free of impurities having a pK, of at least 8, said diamine having the formula:

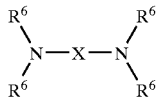

wherein each $R^6$ is independently selected from the group consisting of hydrogen, $C_1$–$C_4$ alkyl, alkyleneoxy having the formula:

$$—(R^7O)_mR^8$$

wherein $R^9$ is $C_2$–$C_4$ linear or branched alkylene, and mixtures thereof; $R_7$ is hydrogen $C_1$–$C_4$ alkyl and mixtures thereof; m is from 1 to 10; X is a unit selected from:

i) $C_3$–$C_{10}$ linear, cyclic, or branched alkylene alkyleneoxyalkylene having the formula:

$$—(R^7O)_mR^7—$$

wherein $R^7$ and m are the same as defined herein;

ii) a $C_3$–$C_{14}$ linear, cyclic, or branched alkylene, $C_4$–$C_{10}$ arylene; wherein said unit comprises one or more electron donating or electron withdrawing moieties which provide said diamine with a pK, greater than 8;

iii) and mixtures thereof:

C) From 0.0001% to 2% by weight, of an enzyme selected from proteases, amylases, lipases, and mixtures thereof;

D) 0.001% to about 5% by weight, of a non-diamine stabilizers selected from antioxidants, chelants, and mixtures thereof;

E) from 0.00001% to 99.5% by weight of a conventional band dishwashing adjunct; and F) from 0.01% to 7% by weight of a divalent ion selected from the group consisting of magnesium, calcium and mixtures thereof.

2. A composition according to claim 1 wherein said surfactant system further comprises one or more noncrystallinity-disrupted alkylarylsulfonate surfactant having the formula:

$$(L—Ar—D)_a(M^{q+})_b$$

wherein L is a $C_2$–$C_{20}$ linear hydrocarbyl unit; D is $—SO_3^-$, M is a cation, q is the cation valence, a and b are numbers having values which provide said surfactant with charges neutrality; Ar is selected from benzene, toluene, and mixtures thereof.

3. A composition according to claim 1 wherein said surfactant system further comprises a surfactant selected from the group consisting of alkylene carbonates, monoalkyl succinamates, alkylpolysaccharides, ethoxylated glycerol type compounds, and mixtures thereof.

4. A composition according to claim 1 wherein said alkylarysulfonate surfactant admixture has a Sodium Critical Solubility Temperature of 20° C. or less.

5. A composition according to claim 1 wherein said conventional hand dishwashing adjunct is selected from the group consisting of builders, at least partially water-soluble or water dispersible polymers, abrasive, bactericides, tarnish inhibitors, dyes, solvents, hydrotropes, perfumes, thickeners, processing aids, suds booster, suds suppressors, suds stabilizers, carriers, enzyme stabilizers, polysaccharides, buffers, anti-fungal agents, mildew control agents, insect repellents, anti-corrosive aids, and mixtures thereof.

6. A composition according to claim 1 wherein the surfactant system comprises from 0.5% to 25% by weight of the surfactant system of a polyalkleneoxy nonionic surfactant, said polyalkleneoxy nonionic surfactant comprising:

i) a hydrophobic group selected from $C_{10}$–$C_{16}$ linear alkyl, $C_{10}$–$C_{18}$ alkyl having 1–3carbon atom branching $C_{10}$–$C_{16}$ Guerbet alkyl, and mixtures thereof; and ii) a hydrophilic group comprising from 1 to 15 $C_{2-4}$ alkyleneoxy units, said alkyleneoxy units said units capped with a sulfate moiety.

7. A composition according to claim 1 wherein the surfactant system comprises from 0.5% to 25% by weight of the surfactant system, of a $C_{10}$–$C_{16}$ linear alkyl sulfate, $C_{10-18}$ alkyl sulfate having 1–3 carbon atom branching, $C_{10}$–$C_{16}$ Guerbet alkyl sulfate surfactant, and mixtures thereof.

8. A composition according to claim 1 wherein the surfactant system comprises from 0.5% to 25% by weight of the surfactant system, of an alkyl alkyleneoxy sulfate surfactant, said surfactant comprising:

i) a hydrophobic group selected from $C_{10}$–$C_{16}$ linear alkyl, $C_{10}$–$C_{18}$ alkyl having 1–3carbon atom branching, $C_{10}$–$C_{16}$ Guerbet alkyl, and mixtures thereof; and ii) a hydrophilic group comprising from 1 to 15 $C_{2-4}$ alkyleneoxy units, said alkyleneoxy units said units capped with a sulfate moiety.

9. A composition according to claim 1 wherein said diamine is selected from the group consisting of dimethyl amino propylenediamine, 1,6-hexane diamine, 1,3-propane diamine, 2-methyl-1,5-pentanediamine, 2,3-pentanediamine, 1,3-diaminobutane 1,2-bis-(2-aminoethoxy)ethane, isophoronediamine, 1,3-bis (methylamine)cyclohexane, and mixtures thereof.

10. A composition according to claim 1 wherein said conventional hand dishwashing adjunct comprises a polymeric or copolymeric suds stabilizer, said stabilizer having a molecular weight of from 1,000 to 2,000,000 daltons and comprising units selected from the group consisting of:

i) N,N-(dialkylamido) alkyl esters having the formula:

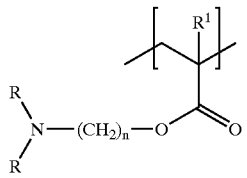

wherein each R is independently selected from hydrogen, $C_2$–$C_4$ alkyl, and mixtures thereof; $R^1$ is hydrogen, $C_1$–$C_4$ alkyl, and mixtures thereof; n is from 2 to 6;

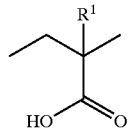

wherein $R^1$ is hydrogen, $C_1$–$C_6$ alkyl, and mixtures thereof:

iii) and mixtures thereof provided that the ratio of (ii) to (i) is from 2 to 1 to 1 to 2.

11. A composition according to claim 1 wherein the surfactant system further comprises from 0.5% to 25% by weight of said surfactant system, of an alkyl alkyleneoxy sulfate surfactant, said surfactant comprising:

i) a hydrophobic group selected from $C_{10}$–$C_{16}$ linear alkyl, $C_{10}$–$C_{18}$ alkyl having 1–3 carbon atom branching, $C_{10}$–$C_{16}$ Guerbet alkyl, and mixtures thereof; and ii) a hydrophilic group comprising from 1 to 15 $C_{2-4}$ alkyleneoxy units, said alkyleneoxy units said units capped with a sulfate moiety.

12. A method for washing tableware comprising the step of contacting tableware with an aqueous solution containing a hand dishwashing composition according to claim 1.

13. A composition according to claim 1 wherein said crystallinity-disrupted alkylarylsulfonate surfactcants include two or more homologs.

14. A composition according to claim 1 wherein said crystallinity-disrupted alkylarylsulfonate surfactcants include two or more isomers selected from the group consisting of:

i) ortho-, meta- and para- isomers based on positions of attachment of B and D to Ar, when Ar is a substituted or unsubstituted benzene;

ii) positional isomers based on positions of attachment of said crystallinity-disrupting moieties to said hydrocarbyl moiety; and iii) stereoisomers based on chiral carbon atoms in B;

iv) positional isomers based on position of attachment of Ar to B at the first, second or third carbon atom in said hydrocarbyl moiety.

15. A composition according to claim 14 wherein said crystallinity-disrupted alkyiaryl sulfonate surfactant includes at least about 60% by weight of said surfactant system of positional isomers based on position of attachment of Ar to B at the first, second, or third carbon atoms in said hydrocarbyl moiety.

16. A method of reducing malodor in a hand dishwashing composition comprising:

A) from 0.1% to 99.9% by weight, of a surfactant system comprising:

i) from 10% to 80% by weight of said surfactant system, of of two or more alkylarylsulfonate surfactants of formula:

$$(B—Ar—D)_a(M^{q+})_b$$

wherein D is $—SO_3^-$, M is a cation, q is the cation valence, a and b are numbers having values which provide said surfactant with charge neutrality; Ar is selected from benzene, toluene, and mixtures thereof; B comprises a $C_3$–$C_{20}$ hydrocarbyl moiety and a crystallinity-disrupted moiety; said crystallinity-disrupted moiety interrupts or branches from said hydrocarbyl moiety and is selected from the group consisting of:

I) one or more branches selected from $C_1$–$C_3$ alkyl, $C_1$–$C_3$ alkoxy, hydroxy, and mixtures thereof;

II) one or more interrupts selected from the group consisting of —O—, $—OSi(CH_3)_2—O—$, —SO—, and mixtures thereof;

wherein said surfactants system has a Sodium Critical Solubility Temperature of 40° C. or less; and at least one of the following:

a) modified SCAS test biodegradation which exceeds the value obtained for tetrapropylene benzene sulfonate; or b) a ratio of at least 5:1 by weight, of non-quaternary carbon atoms to quaternary carbon atoms which comprise B;

ii) from 0.1% to 20% by weight, of an amine oxide selected from the formula $$R^3(OR^4)_xN(\overset{O}{\overset{|}{}})(R^5)_z$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and $R^3$ is an alkyl or hydroxyalkyl group containing from about 1 to about 3 carbon atoms or a polyethylene oxide group containing from about 1 to about 3 ethylene oxide groups;

iii) optionally one or more detersive surfactants other than (i) and (ii) wherein the one or more detersive surfactants comprises 0 to 40 ppm hydrogen peroxide;

B) a diamine having a $pK_a$of at least 8, said having the formula:

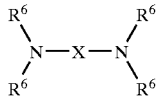

wherein each $R_6$ is independently selected from the group consisting of hydrogen, $C_1$–$C_4$ alkyl, alkyleneoxy having the formula:

$$—(R^7O)_mR^8$$

wherein $R^7$ is $C_2$–$C_{10}$ linear or brnched alkylene, and mixtures thereof; $R^8$ is hyrogen, ($C_1$–$C_4$) alkyl, and mitured therof ; mis from I to IO; X is a unit selected from:

i) $C_1$–$C_{10}$ linear, cyclic, or branched alkylene, alkyleneoxyalkylene having the formula:

$$—(R^7O)_mR^1—$$

wherein $R^7$ and m are the same as define herein;

ii) a $C_3$–$C_{10}$ linear, cyclic, or branched alkylene, $C_4$–$C_{10}$ arylene; wherein said unit comprises one or more electron donating or electron withdrawing moieties which provide said diamine with a $pK_a$ greater than 8;

iii) and mixtures thereof;

C) From 0.0001% to 2% by weight, of an enzyme selected from proteases, amylases, lipases, and mixtures thereof;

D) 0.001% to about 5% by weight, of a non-diamine stabilizers selected from antioxidants, chelants, and mixtures thereof;

E) from 0.00001% to 99.9% by weight, of a convention hand dishwashing adjunct; and F) from 0.01% to 7% by weight of a divalent ion selected from the group consisting of magnesium, calcium and mixtures thereof wherein the diamine substantially free of impurities and the amine oxide comprises from 0 to 40 ppm hydrogen peroxide and from 0 to 40 ppm amine impurities.

* * * * *